US010704297B2

(12) United States Patent
Liang et al.

(10) Patent No.: US 10,704,297 B2
(45) Date of Patent: Jul. 7, 2020

(54) IMPACT RESISTANT LOCK AND TILT LATCH COMBINATION FOR A SLIDING SASH WINDOW

(71) Applicant: Vision Industries Group, Inc., So. Plainfield, NJ (US)

(72) Inventors: Luke Liang, So. Plainfield, NJ (US); David Chen, Guangzhou (CN); Glen Paesano, Point Pleasant Beach, NJ (US)

(73) Assignee: Vision Industries, Inc., So. Plainfield, NJ (US)

( * ) Notice: Subject to any disclaimer, the term of this patent is extended or adjusted under 35 U.S.C. 154(b) by 1307 days.

(21) Appl. No.: 14/879,436

(22) Filed: Oct. 9, 2015

(65) Prior Publication Data

US 2016/0060920 A1 Mar. 3, 2016

Related U.S. Application Data

(63) Continuation-in-part of application No. 14/566,908, filed on Dec. 11, 2014, now abandoned, and a (Continued)

(51) Int. Cl.
*E05B 65/08* (2006.01)
*E05B 9/08* (2006.01)

(Continued)

(52) U.S. Cl.
CPC ..... *E05B 65/0841* (2013.01); *E05B 9/08* (2013.01); *E05C 1/12* (2013.01); *E05C 3/045* (2013.01);

(Continued)

(58) Field of Classification Search
CPC ..... E05B 9/08; E05B 65/0841; E05C 1/08; E05C 3/046; E05C 1/12; E05C 3/045;

(Continued)

(56) References Cited

U.S. PATENT DOCUMENTS 539,030 A 5/1859 Bitner
36,524 A 9/1862 Minor (Continued)

FOREIGN PATENT DOCUMENTS

GB 0341207 1/1931
GB 2026594 2/1980

(Continued)

*Primary Examiner* — Christine M Mills
(74) *Attorney, Agent, or Firm* — Thomas A. O'Rourke; Bodner & O'Rourke, LLP

(57) ABSTRACT

A sash window fastener includes lock and latch assemblies, and a fitting. The lock mounts upon the meeting rail, and includes a pivotable cam to engage a keeper on the master frame, and a pivotable arm acting as a follower. The arm interconnects with the latch within the meeting rail, so cam rotation controls arm positioning—causing translation of the latch. The cam can occupy three positions causing three corresponding latch positions: an extended position securing the cam to the keeper, with the latch engaging the master frame to prevent tilting, and also receiving a post of the fitting therein to further secure the window against impact loading; a first retracted position disengaging the cam from the keeper, and permitting sliding of the window into an open position that also elevates the latch member above the post; and a second retracted cam position causing latch member retraction that permits tilting.

15 Claims, 20 Drawing Sheets

Related U.S. Application Data continuation-in-part of application No. 14/278,226, filed on May 15, 2014, now Pat. No. 10,323,446, and a continuation-in-part of application No. 14/198,986, filed on Mar. 6, 2014, now Pat. No. 10,119,310.

(51) Int. Cl.

| | |
|---|---|
| ***E05C 1/12*** | (2006.01) |
| ***E05C 3/04*** | (2006.01) |
| *E05C 9/20* | (2006.01) |
| *E05C 7/00* | (2006.01) |

(52) U.S. Cl.

CPC ..... *E05C 9/20* (2013.01); *E05C 2007/007* (2013.01); *Y10T 292/0977* (2015.04)

(58) Field of Classification Search

CPC ..... E05C 2007/007; E05C 9/185; E05C 9/20; E05C 9/025; E05C 9/042; Y10T 292/0969; Y10T 292/1039; Y10T 292/104; Y10T 292/1041; Y10T 292/0977; Y10S 292/20; Y10S 292/47; Y10S 292/63

USPC ..... 292/240–242, 163, 169, DIG. 20, 292/DIG. 47, DIG. 63

See application file for complete search history.

(56) References Cited

U.S. PATENT DOCUMENTS 51,222 A 11/1865 Ridell
108,778 A 11/1870 Gorman
115,781 A 6/1871 Steele
126,872 A 5/1872 Buckman
148,857 A 3/1874 Smith
166,842 A 8/1875 Berryman
176,360 A 6/1876 Cooper
178,360 A 6/1876 Cooper
192,614 A 7/1877 Andrews
192,919 A 7/1877 Hoyt
201,146 A 3/1878 Adler
215,125 A 5/1879 Hunter
226,033 A 3/1880 Burns
230,476 A 7/1880 Green
234,387 A * 11/1880 Burgess et al. ..... E05B 65/0042 292/242
284,993 A * 9/1883 Abele ..... A45C 13/06 292/204
534,185 A 2/1885 Winchester
314,350 A 3/1885 Smith
316,285 A 4/1885 McKeen
331,005 A 11/1885 Sahr
336,302 A 2/1886 Dudgeon
346,788 A 8/1886 Teufel
350,678 A 10/1886 Hussey
353,287 A 11/1886 Chumard
369,885 A 9/1887 Shaw
375,656 A 12/1887 Shaw
376,252 A 1/1888 McIntyre
379,910 A 3/1888 McIntyre
410,728 A 9/1889 Brown
417,868 A 12/1889 Rosentreter
423,761 A 3/1890 Hasenpflug
452,723 A 5/1891 Schmalhausen
480,148 A 8/1892 Theby
493,159 A 3/1893 Gibson
509,941 A 12/1893 Perry
512,593 A 1/1894 Webster et al.
520,754 A 5/1894 Burmeister
526,118 A 9/1894 Sharp
528,656 A 11/1894 Burmeister
530,078 A 12/1894 Ammerman
537,258 A 4/1895 Wilcox
551,181 A 12/1895 Dillon
551,242 A 12/1895 Wallace
554,448 A 2/1896 Keil
564,426 A * 7/1896 Hubbard ..... E05B 65/0042 292/242
587,424 A 8/1897 Bonine
590,225 A 9/1897 Hill
653,458 A 7/1900 Paquette
683,928 A 10/1901 Geraghty
688,491 A 12/1901 Sigler
695,736 A 3/1902 Kendrick
699,696 A 5/1902 Mellen
708,406 A 9/1902 Robison
714,343 A 11/1902 Wellman
718,007 A 1/1903 Linn
719,981 A 2/1903 Adams
722,162 A 3/1903 St. Louis
724,466 A 4/1903 Hannan
743,716 A 11/1903 Hacka
744,755 A * 11/1903 Hasenpflug ..... E05B 65/0042 292/242
745,888 A 12/1903 McElwee
756,453 A 4/1904 Arens
756,559 A * 4/1904 Arens ..... E05B 65/0042 292/242
757,249 A 4/1904 Barnard
759,642 A 5/1904 Sparks
764,493 A 7/1904 Noseworthy
769,386 A 9/1904 Johnson
769,767 A 9/1904 Phelps
774,536 A 11/1904 Saunders
775,602 A 11/1904 Heamshaw
800,043 A 9/1905 Witte
804,994 A 11/1905 Andrews
815,537 A 3/1906 Kissinger
833,900 A 10/1906 Sigler
837,811 A 12/1906 Ebbeson
840,427 A 1/1907 Brister
865,090 A 9/1907 Eddy
866,073 A 9/1907 Saunders
878,206 A 2/1908 Johnson
881,658 A 3/1908 Bowman
886,108 A 4/1908 Allen
887,690 A 5/1908 Pearce
922,894 A 5/1908 Heid
897,719 A 9/1908 Daubaignan
900,079 A 10/1908 Bittorf
910,850 A * 1/1909 Petrie ..... E05B 65/0042 292/204
926,899 A 7/1909 Roy
928,408 A 7/1909 Taube
948,628 A 2/1910 Jefferis
959,150 A 5/1910 Morris
966,063 A 8/1910 Toothaker
976,777 A 11/1910 Brown
980,131 A 12/1910 Shean
998,642 A 7/1911 Shean
1,003,386 A 9/1911 Welker
1,006,211 A 10/1911 Hermon
1,020,454 A 3/1912 Seidenbecker
1,041,803 A 10/1912 Kilburn
1,051,918 A 2/1913 Rowley
1,059,999 A 4/1913 James et al.
1,069,079 A 7/1913 Voight
1,077,487 A 11/1913 Miller
1,080,172 A 12/1913 Rusk
1,100,820 A 6/1914 Edwards
1,121,228 A 12/1914 Burkhan
1,122,026 A * 12/1914 O'Rourke ..... E05B 65/0042 292/204
1,127,835 A 2/1915 Westlund
1,133,217 A 3/1915 Barton
1,141,437 A 6/1915 Unterlender
1,148,712 A 8/1915 Overland
1,163,086 A 12/1915 Harper
1,173,129 A 2/1916 Taliaferro
1,177,637 A 4/1916 Lane
1,177,838 A 4/1916 Wilkinson
1,207,989 A 12/1916 O'Rourke
1,232,683 A 7/1917 Hollis

(56) References Cited

U.S. PATENT DOCUMENTS 1,243,115 A 10/1917 Shur
1,247,182 A 11/1917 Tuekmantel
1,253,810 A 1/1918 Gianninoto
1,261,274 A 4/1918 Newsam
1,269,467 A 6/1918 Winters
1,270,740 A 6/1918 Keyes
1,272,900 A 7/1918 Berman
1,279,353 A 9/1918 Keiley
1,311,052 A 7/1919 Danforth
1,322,677 A 11/1919 Ditlefsen
1,338,250 A * 4/1920 Parkes ..... E05C 3/046 292/204
1,338,416 A 4/1920 Bellinger
1,339,362 A * 5/1920 L Heureux ..... E05D 15/00 292/241
1,341,234 A 5/1920 Horton
1,350,698 A 8/1920 Boedtcher
1,387,302 A 8/1921 Page
1,388,272 A 8/1921 Lawrence
1,393,628 A 10/1921 Leichter
1,398,174 A 11/1921 Carlson
1,399,897 A 12/1921 Singer
1,412,154 A 4/1922 Wollesen
1,439,585 A 12/1922 Trost
1,461,467 A 7/1923 Stuart
1,463,866 A 8/1923 Bourbeau
1,485,382 A 3/1924 Foley
1,490,874 A 4/1924 Webb
1,516,995 A 11/1924 Trigueiro
1,550,532 A 8/1925 French
1,552,690 A 9/1925 Frantz
1,601,051 A 9/1925 Wilbert
1,587,037 A 6/1926 Rudolph
1,605,717 A 11/1926 Gregg
1,619,031 A 3/1927 Ostrosky
1,622,742 A 3/1927 Shipman
1,658,818 A 1/1928 Dillon
1,692,579 A 11/1928 Schrader
1,704,946 A * 3/1929 Lindgren ..... E05D 13/06 219/137 R
1,712,792 A 5/1929 Hansen
1,715,957 A 6/1929 Stein
1,724,637 A 8/1929 Bergstrom
1,747,576 A * 2/1930 Caldwell ..... E06B 3/50 292/DIG. 20
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,869,274 A 7/1932 Phillips
1,891,940 A 12/1932 McAllister
1,900,936 A 3/1933 Macy
1,901,974 A 3/1933 Macy
1,922,062 A 8/1933 Sullivan
1,960,034 A 5/1934 Stewart
1,964,114 A 6/1934 Gerlach et al.
2,095,057 A 10/1937 Corrado
2,122,661 A 7/1938 Rightmyer
2,126,995 A 8/1938 Kingdon
2,136,408 A 11/1938 Bedell
2,158,260 A 5/1939 Stillman
2,202,561 A 5/1940 Lahiere
2,272,145 A 2/1942 Anderson et al.
2,326,084 A 8/1943 Westrope
2,369,584 A 2/1945 Lundholm
2,452,521 A 10/1948 Johnson et al.
2,480,016 A 8/1949 Granberg
2,480,988 A 8/1949 Granberg
2,500,849 A 3/1950 Menns
2,503,370 A 4/1950 Zanona
2,523,559 A 9/1950 Couture
2,527,278 A 10/1950 Schemansky
2,537,736 A 1/1951 Carlson
2,590,624 A 3/1951 James
2,560,274 A 7/1951 Cantelo
2,599,196 A 6/1952 Peremi
2,605,125 A 7/1952 Emerson
2,612,398 A 9/1952 Miller
2,613,526 A 10/1952 Holmstein
2,621,951 A 12/1952 Ostacai
2,645,515 A 7/1953 Thomas
2,648,967 A 8/1953 Holmstein
2,670,982 A 3/1954 Barnam
2,692,789 A 10/1954 Rivard
2,758,862 A 8/1956 Endter
2,766,492 A 10/1956 Day et al.
2,789,851 A 4/1957 Lickteig
2,818,919 A 1/1958 Sylvan
2,846,258 A 8/1958 Granberg
2,855,772 A 10/1958 Hillgren
2,884,276 A 4/1959 Baptist
2,941,832 A 6/1960 Grossman
2,965,935 A * 12/1960 Olsen ..... E06B 3/44 160/381
3,027,188 A 3/1962 Eichstadt
3,135,542 A * 6/1964 Wilkinson ..... E05C 3/046 267/164
3,187,526 A 6/1965 Moler
3,267,613 A 8/1966 McQuiston
3,288,510 A 11/1966 Gough
3,352,586 A 11/1967 Hakanson
3,362,740 A 1/1968 Burns
3,422,575 A 1/1969 Armstrong
3,438,153 A 4/1969 Lemme
3,599,452 A 8/1971 Yokohama et al.
3,600,019 A 8/1971 Toyota
3,642,315 A 2/1972 Alpern
3,645,573 A 2/1972 Strang
3,683,652 A 8/1972 Halopoff et al.
3,706,467 A 12/1972 Martin
3,762,750 A 10/1973 Orr
3,811,718 A 5/1974 Bates
3,907,348 A 9/1975 Bates
3,919,808 A 11/1975 Simmons
3,927,906 A 12/1975 Mieras
4,054,308 A 10/1977 Prohaska
4,059,298 A 11/1977 van Klompenburg
4,063,766 A 12/1977 Granberg
4,068,871 A 1/1978 Merger
4,095,827 A 6/1978 Stavenau
4,095,829 A 6/1978 van Klompenburg
4,102,546 A 7/1978 Costello
4,151,682 A 5/1979 Schmidt
4,165,894 A 8/1979 Wojciechowski
4,223,930 A 9/1980 Costello
4,227,345 A 10/1980 Durham, Jr.
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt et al.
4,392,329 A 7/1983 Suzuki
4,429,910 A 2/1984 Anderson
4,470,277 A 9/1984 Uyeda
4,475,311 A 10/1984 Gibson
4,525,952 A 7/1985 Cunningham et al.
4,580,366 A 4/1986 Hardy
4,587,759 A 5/1986 Gray
4,621,847 A 11/1986 Paulson
4,624,073 A 11/1986 Randall
4,639,021 A 1/1987 Hope
4,643,005 A 2/1987 Logas
4,736,972 A 4/1988 Mosch
4,801,164 A 1/1989 Mosch
4,813,725 A 3/1989 Mosch
4,824,154 A 4/1989 Simpson
4,827,685 A 5/1989 Schmidt
4,893,849 A 1/1990 Schlack
4,922,658 A 5/1990 Coddens
4,949,506 A 8/1990 Durham, Jr.
4,961,286 A 10/1990 Bezubic

(56) References Cited

U.S. PATENT DOCUMENTS 4,991,886 A 2/1991 Nolte
5,042,855 A 8/1991 Bennett
5,072,464 A 12/1991 Draheim et al.
5,076,015 A 12/1991 Manzalini
5,087,087 A 2/1992 Vetter et al.
5,087,088 A 2/1992 Milam
5,090,750 A 2/1992 Lindqvist
5,090,754 A 2/1992 Thompson
5,110,165 A 5/1992 Piltingsrud
5,127,685 A 7/1992 Dallaire et al.
5,139,291 A 8/1992 Schultz
5,143,412 A 9/1992 Lindqvist
5,161,839 A * 11/1992 Piltingsrud ..... E05C 3/046 292/241
5,165,737 A 11/1992 Riegelman
5,183,310 A 2/1993 Shaughnessy
5,219,193 A 6/1993 Piltingsrud
5,244,238 A * 9/1993 Lindqvist ..... E05B 65/0841 292/36
5,248,174 A 9/1993 Matz
5,274,955 A 1/1994 Dallaire et al.
5,341,752 A 8/1994 Hambleton
5,398,447 A 3/1995 Morse
5,437,484 A 8/1995 Yamada
5,448,857 A 9/1995 Stormo
5,452,925 A 9/1995 Huang
5,454,609 A 10/1995 Slocomb et al.
5,560,149 A 10/1996 Lafevre
5,582,445 A 12/1996 Olsen
RE35,463 E 2/1997 Vetter
5,636,475 A 6/1997 Nidelkoff
5,688,000 A 11/1997 Dolman
5,715,631 A 2/1998 Kailian et al.
5,741,032 A 4/1998 Chaput
5,778,602 A 7/1998 Johnson
5,791,700 A 8/1998 Biro
5,829,196 A 11/1998 Maier
5,839,767 A 11/1998 Piltingsrud
5,873,199 A 2/1999 Meunier et al.
5,901,499 A 5/1999 Delaske et al.
5,901,501 A 5/1999 Fountaine
5,911,763 A 6/1999 Quesada
5,927,768 A 7/1999 Dallmann
5,970,656 A 10/1999 Maier
5,992,907 A 11/1999 Sheldon et al.
6,000,735 A 12/1999 Jourdenais
6,086,121 A 7/2000 Buckland
6,112,463 A 9/2000 Reithmeyer
6,116,665 A 9/2000 Subliskey
6,135,510 A 10/2000 Diginosa
6,139,071 A 10/2000 Hopper
6,142,541 A 11/2000 Rotondi
6,155,615 A 12/2000 Schultz
6,161,335 A 12/2000 Beard et al.
6,176,041 B1 1/2001 Roberts
6,178,696 B1 1/2001 Liang
6,183,024 B1 2/2001 Schultz et al.
6,209,931 B1 4/2001 Stoutenborough et al.
6,217,087 B1 4/2001 Fuller
6,230,443 B1 5/2001 Schultz
6,257,303 B1 7/2001 Coubray et al.
6,279,266 B1 8/2001 Searcy
6,349,576 B2 2/2002 Subliskey
6,364,375 B1 4/2002 Szapucki
6,422,287 B1 7/2002 Wilke
6,546,671 B2 4/2003 Mitchell et al.
6,565,133 B1 5/2003 Timothy
6,588,150 B1 7/2003 Wong et al.
6,592,155 B1 7/2003 Lemley et al.
6,607,221 B1 8/2003 Elliott
6,631,931 B2 10/2003 Magnusson
6,634,683 B1 10/2003 Brannan
6,817,142 B2 11/2004 Marshik
6,848,728 B2 2/2005 Rotondi
6,871,885 B2 3/2005 Goldenberg et al.
6,871,886 B2 3/2005 Coleman
6,877,784 B2 4/2005 Kelley et al.
6,925,753 B1 8/2005 Pettit
6,957,513 B2 * 10/2005 Pettit ..... E05B 5/003 292/141
6,983,963 B2 1/2006 Eslick
7,000,957 B2 2/2006 Lawrence
7,013,603 B2 3/2006 Eenigenburg et al.
7,063,361 B1 6/2006 Lawrence
7,070,211 B2 7/2006 Polowinczak et al.
7,070,215 B2 7/2006 Kelley
7,100,951 B2 9/2006 Jien
7,147,255 B2 12/2006 Goldenberg
7,159,908 B2 1/2007 Liang
7,296,831 B2 11/2007 Generowicz
7,322,620 B1 1/2008 Lawrence
7,407,199 B2 8/2008 Richardson
7,415,797 B2 * 8/2008 Dotson ..... E05B 65/0876 49/185
7,481,470 B2 1/2009 Polowinczak
7,500,330 B2 * 3/2009 Fullick ..... E05C 1/10 292/DIG. 47
7,510,221 B2 3/2009 Eenigenburg
7,607,262 B2 * 10/2009 Pettit ..... E05B 5/003 49/185
7,665,775 B1 2/2010 Miller
7,922,223 B2 4/2011 Lawrence
7,963,577 B2 * 6/2011 Wolf ..... E05C 3/046 292/241
7,976,077 B2 * 7/2011 Flory ..... E05B 53/003 292/241
8,205,919 B2 6/2012 Fiory
8,205,920 B2 6/2012 Fiory
8,272,164 B2 * 9/2012 Albrecht ..... E05B 17/2034 292/DIG. 20
8,550,507 B2 10/2013 Barton
8,726,572 B2 5/2014 Derham
8,789,862 B2 7/2014 Liang
8,807,607 B2 * 8/2014 Glickman ..... E05C 3/046 292/241
8,844,985 B2 9/2014 Liang
9,140,033 B2 9/2015 Wolf
2004/0168370 A1 * 9/2004 Pettit ..... E05B 5/003 49/185
2006/0192391 A1 * 8/2006 Pettit ..... E05C 9/046 292/5
2006/0244270 A1 11/2006 Rotondi
2007/0205615 A1 9/2007 Eenigenburg
2008/0169658 A1 7/2008 Wolf
2010/0199726 A1 8/2010 Varney
2010/0218425 A1 9/2010 Nolte
2010/0263415 A1 10/2010 Rupsil
2013/0214545 A1 8/2013 Wolf
2013/0283695 A1 10/2013 Hollermann
2016/0076282 A1 3/2016 Wolf
2017/0234033 A1 * 8/2017 DeBoer ..... E05B 17/22 49/449

FOREIGN PATENT DOCUMENTS

GB 2286627 8/1995
GB 2461079 12/2009
GB 2461108 12/2009
GB 2491107 12/2009

* cited by examiner

IMPACT RESISTANT LOCK AND TILT LATCH COMBINATION FOR A SLIDING SASH WINDOW

CROSS REFERENCE TO RELATED APPLICATIONS

This application is a continuation-in-part of U.S. patent application Ser. No. 14/566,908, filed on Dec. 11, 2014, having the title "Integrated Sash Lock and Tilt Latch Combination with Improved Wind-Force-Resistance Capability," which is a continuation-in-part of U.S. patent application Ser. No. 14/278,226, filed on May 15, 2014, having the title "Integrated Sash Lock and Tilt Latch Combination with Improved Interconnection Capability Therebetween." which is a continuation-in-part of U.S. patent application Ser. No. 14/198,986, filed on Mar. 6, 2014, having the title "Integrated Sash Lock and Tilt Latch with Screwless Installation and Removal from Meeting Rail," with the disclosures of each being incorporated herein by reference.

FIELD OF THE INVENTION

The present invention relates to improvements in locks and tilt latches for slidable sash windows (or doors), and more particularly to improvements to an integral sash lock/tilt latch combination that is capable of providing better resistance to wind loading for improved pressure ratings.

BACKGROUND OF THE INVENTION

Single hung and double hung sliding sash windows are commonly used today in the construction of residential and commercial buildings. Sash locks are typically mounted to the meeting rail of the bottom sash window to lock the sash or sashes, by preventing the lower sash (or both the lower and upper sashes for a double hung window), from being opened through sliding movement relative to the master window frame. Also, in order to assist in the cleaning of the exterior of the glazing of the sash window, it may be constructed differently. Rather than the sash window frame itself being slidable within the master window frame, a lower pivotal member on the sash window may slide therein, and a pair of tilt latch devices mounted on an upper part of the window frame may also slide in the track of the master window frame. The tilt latches may be actuated to be withdrawn from the track to permit tilting of the sash window about the lower pivotal member into the room.

However, this arrangement relies solely upon the tilt latch at the top of the sliding sash window and the pivotal attachment at the bottom of the sash member to provide the structural integrity needed to resist high wind loads, since the sash frame itself is not nested within the track of the master window frame. Because of the annual threat of extreme weather at the eastern coastal areas of the U.S., particularly from hurricanes but also from macro-scale storms (a Nor'easter) that can generate hurricane force winds, these areas often mandate that the windows installed today be constructed according to very high standards. These standards may require the window to be able to structurally withstand, for a set period of time, a specified design pressure, which would permit the window to maintain its integrity throughout the sustained winds of a category five hurricane. Under such loading, it is not uncommon to see a window convex significantly, but when properly designed, the window will regain its original form. This significant deformation under such high wind loads creates a serious problem for the window hardware, particularly the tilt latch, as the latch member merely being biased into the master window frame track does not serve to resist bending. The deformation thus permitted from high wind loads may result in moisture and debris entering the interior of the dwelling through any gaps resulting from the deformation.

Another issue with respect to the design of windows for extreme weather concerns impact loading. An impact resistant sash window may include an impact-resistant glazing housed in a frame that may be securely fastened to the master window frame. The impact resistant glazing may be made of two sheets of glass laminated together, with a shatter-proof membrane between the sheets. If the exterior of the glazing is impacted by debris carried by high speed winds, the outer sheet of glass may shatter, but the inner sheet of glass is protected by the membrane, which may also serve to retain the shattered outer glass fragments in the frame. The inner sheet of glass still prevents the wind and moisture from reaching the interior of the dwelling. However, the tilt latch being unable to resist deformation may nonetheless allows debris and moisture to enter the residence through gaps resulting from such deformation, irrespective of the integrity of the impact-resistant glazing being maintained.

The present invention seeks to provide improvements to the window latch hardware in the form of an integrated sash lock and tilt latch fastener for single hung or double hung windows, which provides better resistance to wind loading and impact loading, for improved window pressure ratings.

OBJECTS OF THE INVENTION

It is an object of the invention to provide a sash lock to prevent relative sliding movement of one or both sliding sash windows that are slidable within a master window frame.

It is another object of the invention to provide a tilt latch to permit pivoting of a sliding sash window inwardly into the room in which the window is installed.

It is a further object of the invention to provide a combination sash lock and tilt latch that act cooperatively through the use of a single handle member.

It is also an object of the invention to provide a Hit latch device that may be blindly coupled to a sash lock for cooperative interaction and actuation therefrom.

It is yet another object of the invention to provide a tilt latch that may better support the sash window frame to resist deformation.

It is also an object of the invention to provide a tilt latch that may be permit the sash window to resist impact loading.

Further objects and advantages of the invention will become apparent from the following description and claims, and from the accompanying drawing figures.

SUMMARY OF THE INVENTION

An integral sash locking and tilt latching fastener for a sliding sash window may include a lock assembly that may be interconnected with a latch assembly.

The lock assembly may be mounted to the top of the meeting rail of the sash window. The lock assembly may include a housing and a cam pivotally mounted within the housing. The cam may be configured to pivot for a portion thereof to protrude out from a cavity in the housing to releasably engage a keeper secured to the master window frame (or secured to a second sliding sash window) in a "locking" position, to lock the sash window (or windows) and prevent both sliding and tilting. The cam may have a graspable hub portion that may protrude upwardly, out from an orifice in the sash lock housing, to permit actuation of the device through rotation of the cam by a user. Alternatively, the device may have a separate handle member secured to the cam, where the handle may provide greater leverage to facilitate easy rotation and counter-rotation of the cam. The lock assembly may also include a lever arm that may be pivotally mounted within the lock housing, and which may be configured for a portion thereof to extend beyond the surface of the housing that is used for mounting of the lock, and into the hollow of the meeting rail of the sash window, when mounted thereon.

The latch assembly may be received through an opening on a side of the sash member. The latch assembly may include a housing, biasing means, and a latch member slidably disposed within the housing. An opening in the latch member is configured to receive the lever arm of the lock assembly, when positioned within the hollow meeting rail, for coupling of motion therebetween. The latch housing, latch member, and biasing means are configured for the biasing means to normally bias the latch member, so that a portion of one end (i.e., a portion of its "tongue") may protrude out from the housing, and out of the side of the sash window frame, when mounted therein.

With the cam rotated into the "locking" position, to prevent sliding of the sash window through engagement of the cam with the keeper, the latch member may also then be in its fully extended position, in which it may be engaged within a track of the master window frame, which engagement may normally serve to prevent tilting of the sash window.

When the cam is actuated to rotate (e.g., 135 degrees), it may move from the extended locking position into a first retracted unlock position—a position where the cam is disengaged from the keeper on the master window frame, and would no longer prevent the sash window from sliding. Rotation of the cam into the first retracted unlock position may cause a portion thereof to be move into proximity to a follower portion of the lever arm, without actuating it, so that the latch member may remain engaged within the track of the master window frame to prevent tilting of the sash window.

When actuation of the shaft/handle member causes the cam to rotate further (e.g., another 45 degrees), it may move the cam from the first retracted unlock position into a second retracted unlock position. Rotation of the cam into the second retracted unlock position may cause the portion thereof being in proximity to the follower portion of the lever arm to contact and actuate the arm, and thereby drive the lever arm to also rotate. The rotational motion of the lever arm may act to oppose the biasing of the latch member, through the interconnection therebetween, to drive the tongue of the latch member to translate and retract into the latch housing, and become disengaged from the track of the master window frame. With the tongue of the latch member withdrawn from the track of the master window frame, the sash window may be tilted into the room.

The cam may be releasably secured in the extended locking position using a detent mechanism. The detent mechanism may also releasably secure the cam at the first retracted cam position, thereby also releasably securing the latch member at the first retracted unlock position, due to the interconnection therebetween. The detent mechanism may also releasably secure the cam at the second retracted unlock position. However, although the detent mechanism may be configured so that it provides a tactile indication to the user as to when the shaft/handle member reaches those positions, the spring of the latch assembly may nonetheless provide a biasing force large enough to overcome the anti-rotation-resisting force provided by the detent mechanism, when the cam is in the second retracted unlock position. Therefore, after the user moves the handle for the cam to reach the second retracted unlock position and thereafter releases the handle, the latch spring may bias the latch member into its extended position, to protrude into the track of the master window frame to again prevent tilting, which may drive the lever arm because of the interconnection therebetween. The lever arm and cam may thus be driven to return to the first retracted unlock position.

Both a left-hand and right-hand version of the above described integral sash locking and tilt latching fastener may be mounted on a sliding sash window, to provide improved impact resistance. Alternatively, only the left-hand or the right hand arrangement may be used to secure the window. The following discussion proceeds with a discussion of one version of the fastener (e.g., the left-hand fastener), with the understanding that a mirror image version may also be formed and used on the window. Also note that the left-hand and right-hand latch arrangements disclosed herein may alternatively be driven by a single sash lock, which may be configured as disclosed in concurrently filed application Ser. No. 14/_____, filed on _-_-2015, having the title, "Integrated Sash Lock and Tilt Latch Combination Using One Lock for Two Tilt Latches," the disclosures of which are incorporated herein by reference.

DETAILED DESCRIPTION OF THE INVENTION

Figure 1:
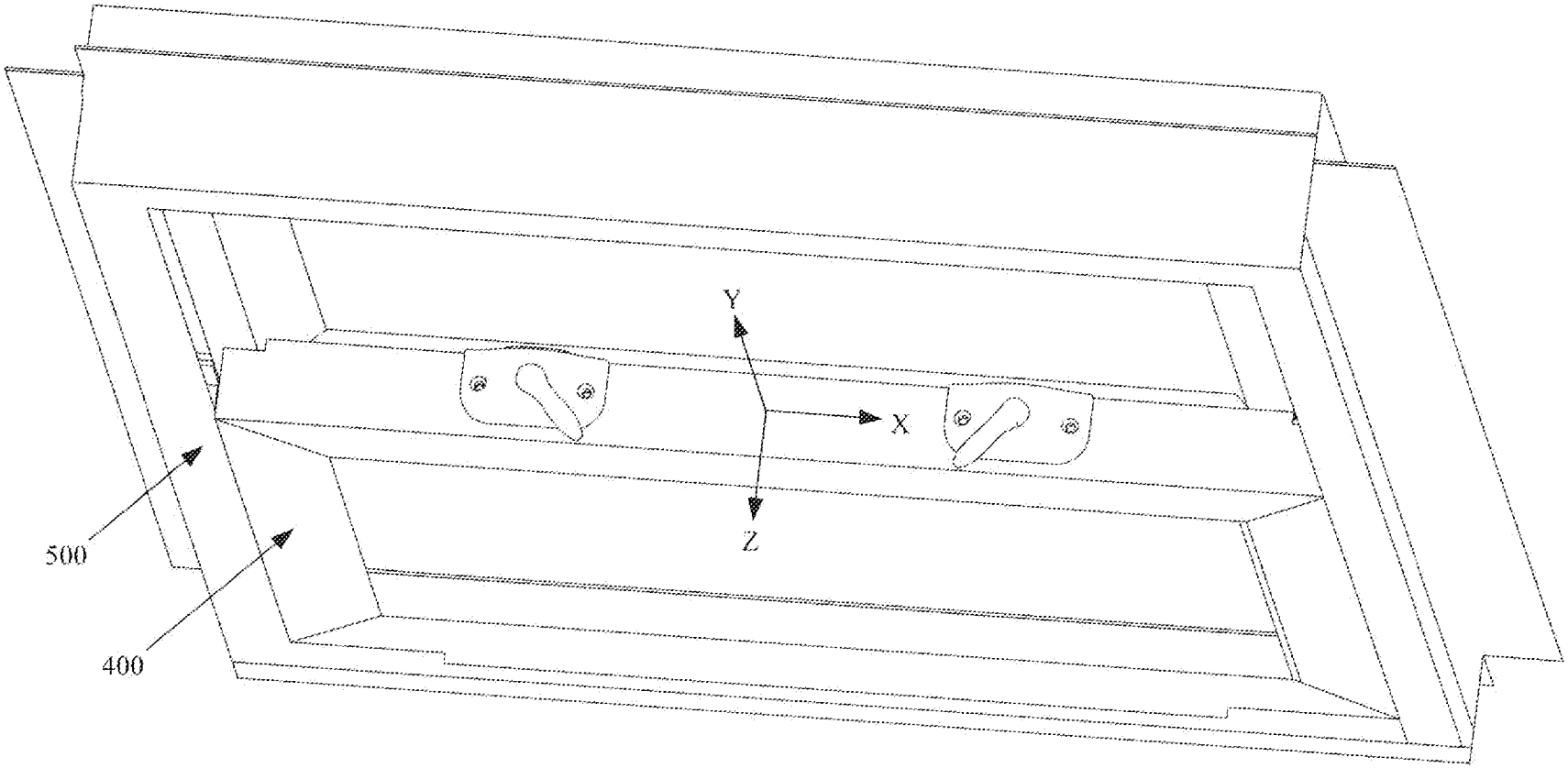
FIG. 1 is a perspective view of a sliding sash window slidably disposed in a master window frame, and which utilizes a left-hand and a right-hand version of the integrated sash lock/tilt latch fastener of the present invention

FIG. 1 shows a left-hand and a right-hand integrated sash lock/tilt latch fastener of the present invention installed with respect to a sliding sash window 400 that is slidably disposed in a master window frame 500. To simplify the presentation herein, the following disclosure is directed only to the left-hand fastener shown in FIG. 1, since the right-hand fastener is a mirrored version of the left-hand fastener, being principally made up of mirror image parts.

Figure 2:
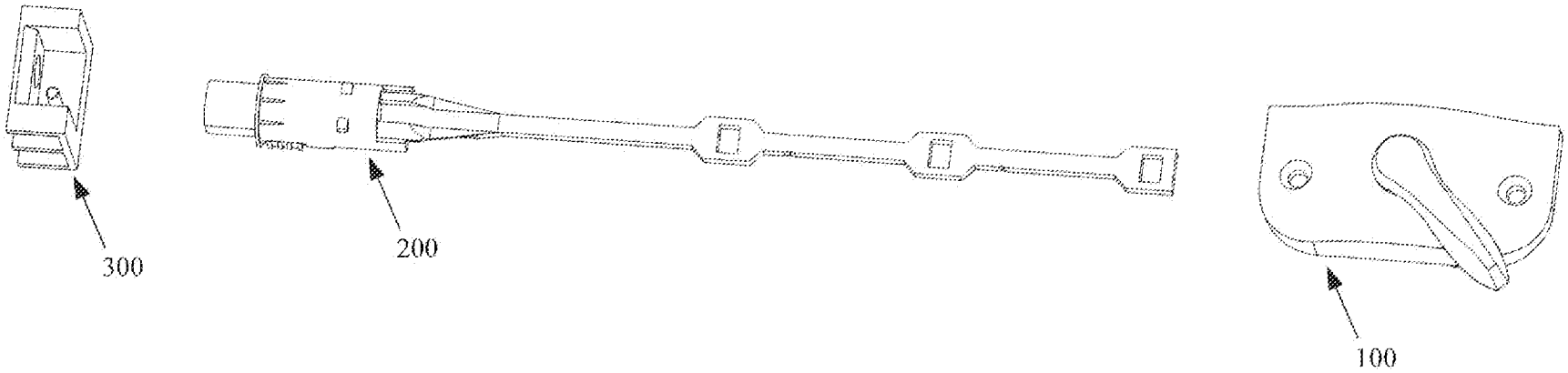
FIG. 2 is an exploded view of the components that are used for the left-handed version of the integrated sash lock/tilt latch fastener of the present invention, and may include a sash lock assembly, a latch assembly, and a fitting.

The left-hand integrated sash lock/tilt latch fastener, as seen in FIG. 2, may include a lock assembly 100, a latch assembly 200, and a fitting assembly 300. The latch assembly 200 may be blindly mated to the lock assembly 100 during installation of each with respect to the sash window 400.

Figure 19:
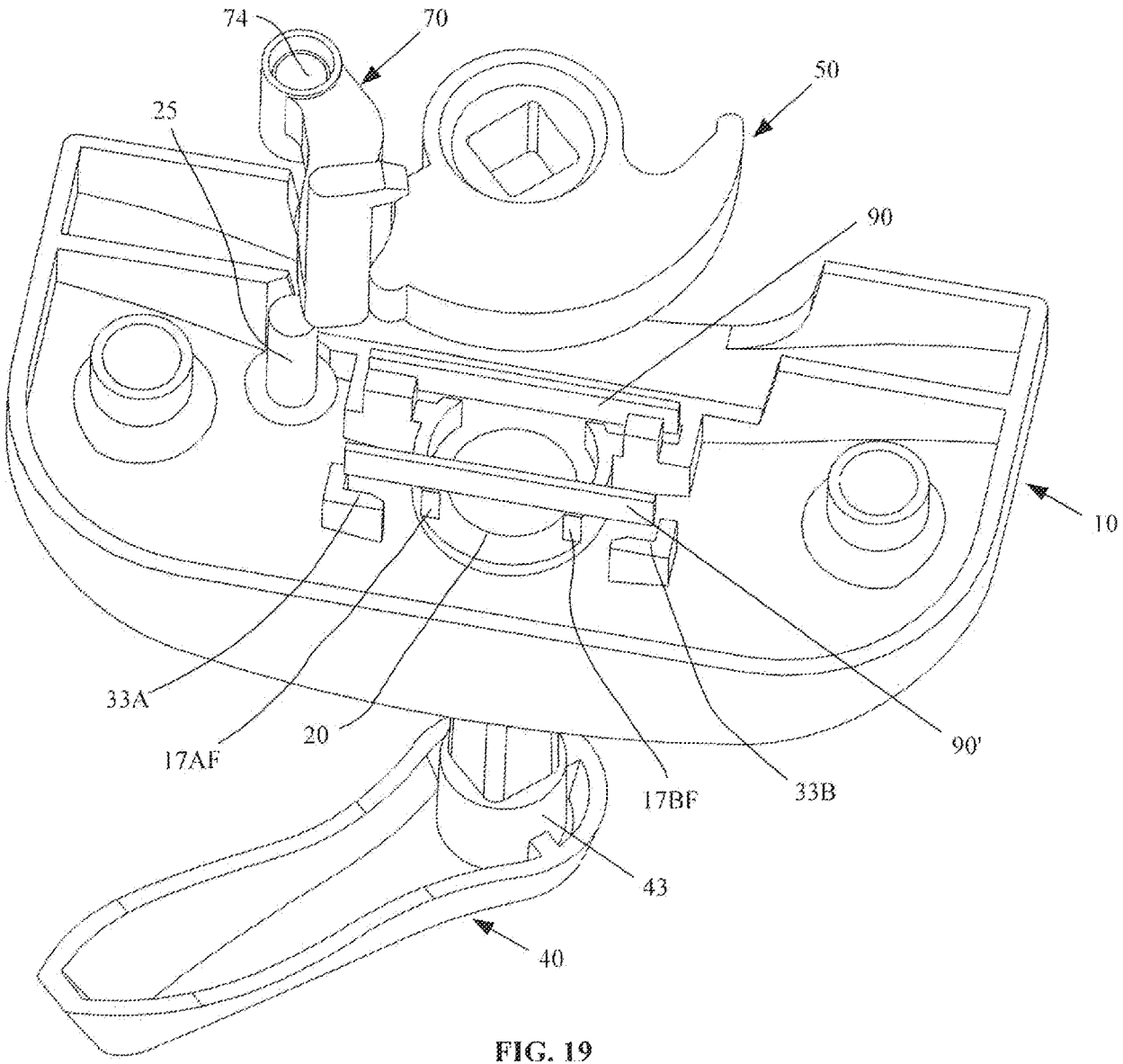
FIG. 19 is an exploded view of the component parts of the sash lock assembly of FIG. 2, shown just prior to being assembled together.

As seen in the exploded view of FIG. 19, the sash lock assembly 100 may include a housing 10, a shaft/handle member 40, a cam 50, a lever arm 70, and a pair of identical leaf springs 90/90'.

Figure 3:
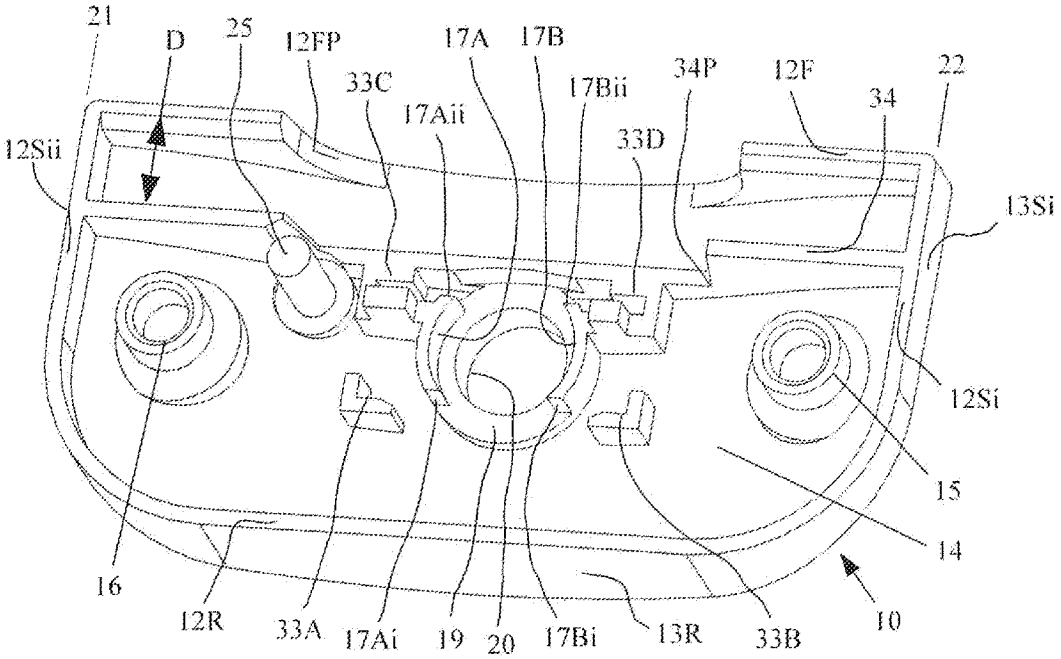
FIG. 3 is a bottom perspective view of the housing used for the sash lock assembly of the integrated sash lock/tilt latch fastener of FIG. 2.
Figure 4:
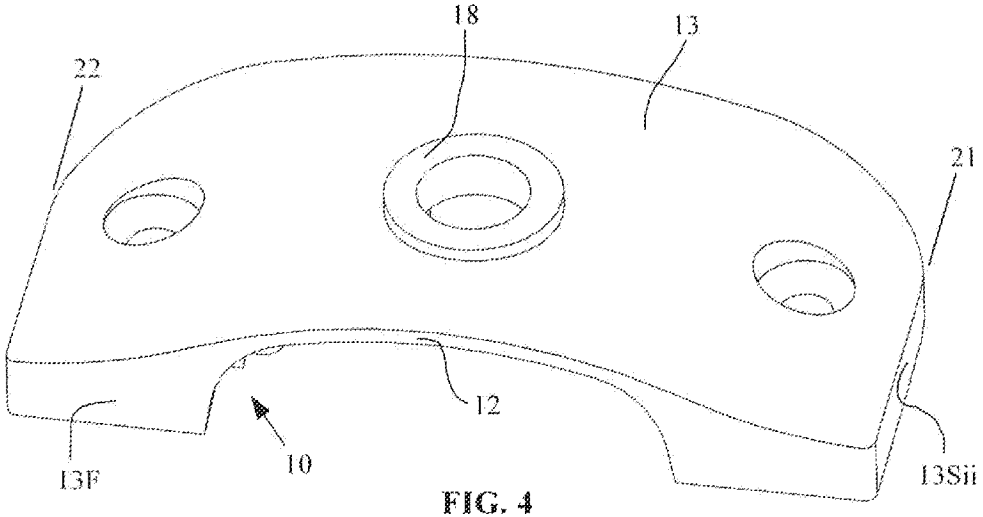
FIG. 4 is a top perspective view showing the exterior of the housing of FIG. 3.

Perspective views of the housing 10 used for the sash lock assembly 100 are shown in FIGS. 3-4. The housing 10 is not limited to the shape illustrated within FIGS. 3-4, and could take on many different appropriate shapes, including a rectangular shape, an irregular shape, etc. However, the housing 10 may be shaped to have a wall 12 formed to have a curved outer surface 13 that may span from a first end 21 of the housing to second end 22. The wall 12 defined by the curved surface 13 may transition to form a first side surface 13Si and a second side surface 13Sii, where the transition thereto may be curved and gradual, or may instead be abrupt to form a sharp edge, as shown in FIG. 4. The wall 12 defined by the curved outer surface 13 may also transition to form a rear surface 13R, which transition may similarly be smooth and gradual, or may instead be abrupt. The wall 12 defined by the curved outer surface 13 may also transition to form a generally flat front surface 13F. The side surfaces 13Si and 13Sii, the rear surface 13R, and the front surface 13F, may each define respective wall portions 12Si, 12Sii, 12R, and 12F, which may transition into each adjacent wall portion, and each of which may terminate on a generally flat bottom surface, for mounting of the sash lock onto the top of the meeting rail of a sash window.

The housing 10 may be generally hollow with the interior surface 14 of wall 12 and the respective interior surfaces of wall portions 12Si, 12Sii, 12R, and 12F forming a cavity. Certain features may protrude into the interior cavity of the housing, including a wall 34 that may be generally parallel to, but offset a distance D away from wall portion 12F. The distance D between wall portion 12F and wall 34 may be sufficient for the housing 10 to overhang a keeper on the master window frame, and receive a portion of the keeper between those walls and beneath the bottom surface 14. The wall portion 12F and the wall 34 may have a respective opening 12FP and 34P formed therein. The opening 12FP in the wall portion 12F may permit a portion of cam 50 to protrude out from the housing in the extending locking position, to engage the keeper therein, and which may be shrouded by the top wall 12.

Extending outwardly from the interior surface 14 of the housing 10 may be at least one hollow cylindrical protrusion that may be used to secure the sash lock assembly 100 to the sash window 400. In one embodiment of the housing 10, two hollow cylindrical protrusions 15 and 16 may be used, and each may be configured to respectively receive a screw for mounting of the sash lock assembly 100 to the sash window 400.

Extending from the interior surface 14 of the housing 10 into the cavity may be a shaft 25, which may be used for pivotal mounting of the lever arm 70 within the housing cavity.

The housing 10 may have a cylindrical boss 18 extending upwardly from the outer surface 13, and may also have a cylindrical boss 19 extending downwardly from the interior surface 14, into the housing cavity. Cylindrical boss 18 and boss 19 may have a through-hole 20. The hole 20 may be used for pivotal mounting of a shaft that may extend from a locking cam 50, or alternatively, the hole 20 may be used for pivotal mounting of a separate shaft/handle member 40, to which the locking cam may instead be fixedly secured.

Figure 5:
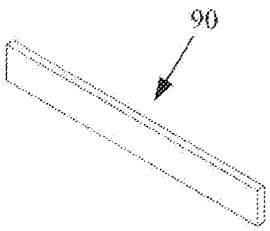
FIG. 5 is a perspective view of a leaf spring that may be used as part of a detent mechanism for the sash lock of FIG. 2.

The housing 10 may also have curved walls 17A and 17B that may protrude from the boss 19 further into the cavity, and which may provide support for the cam 50. Also, additional walls 33A, 33B, 33C, and 33D may protrude into the housing cavity, which may permit fixedly supporting of a first and second leaf spring 90/90' (FIG. 5) therein, in conjunction with flat end surfaces 17Ai, 17Bi, 17Aii, and 17Bii of the curved walls 17A and 17B.

Figure 6:
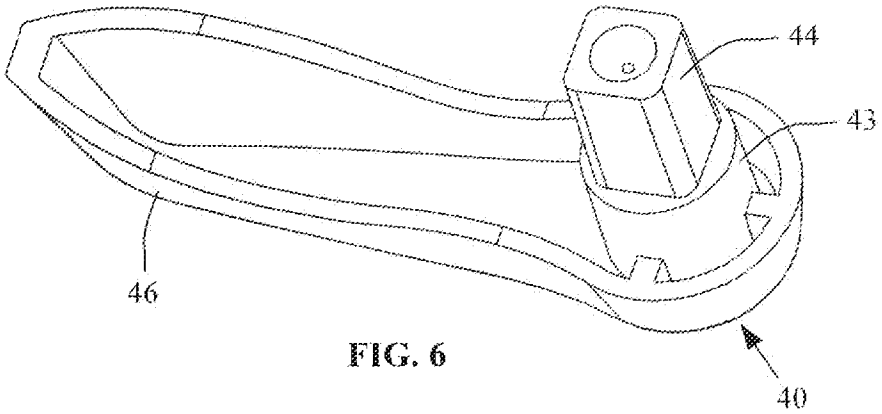
FIG. 6 is a bottom perspective view of the shaft/handle member used for the sash lock assembly of FIG. 2.
Figure 7:
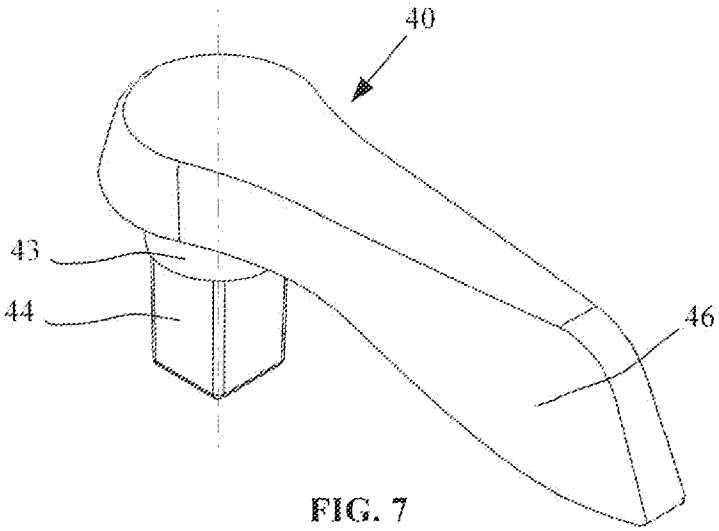
FIG. 7 is a top perspective view of the shaft/handle member of FIG. 6.

As seen in FIGS. 6-7, the shaft/handle member 40 may have a cylindrical shaft 43, one end of which may have a keyed protrusion 44 extending therefrom, which may have an orifice therein. At the other end of the shaft 43, a graspable handle portion 46 may extend generally orthogonally with respect to the axis of shaft 43. The shaft 43 of the shaft/handle member 40 may be configured to be pivotally received within the hole 20 in the housing 10. The keyed protrusion 44 may be any suitable cross-sectional shape, and in this exemplary embodiment, the keyed protrusion is formed using a rectangular shape.

Figure 9:
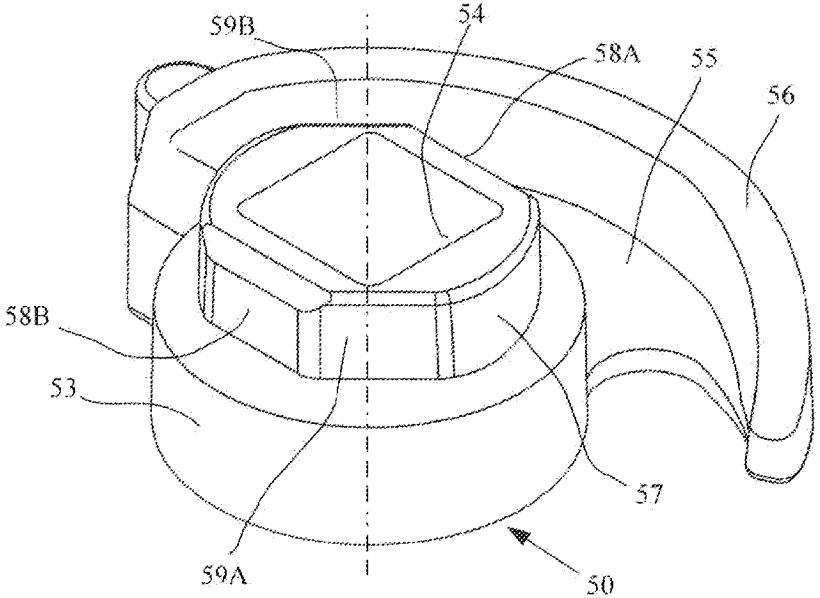
FIG. 9 is a top perspective view of the cam of FIG. 8.
Figure 10:
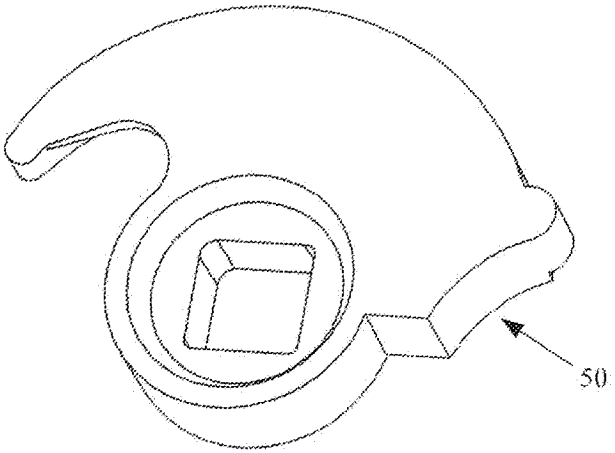
FIG. 10 is a bottom perspective view of the cam of FIG. 8.
Figure 8:
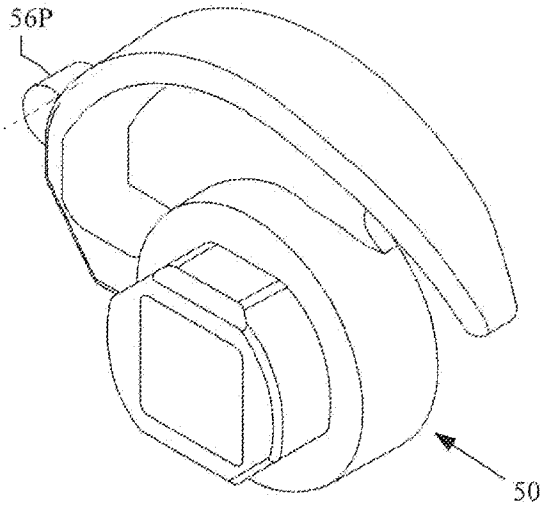
FIG. 8 is a front perspective view of the cam used for the sash lock assembly of FIG. 2.
Figure 12:
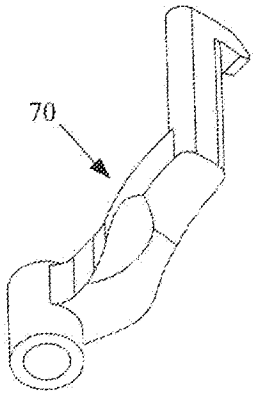
FIG. 12 is a top perspective view of the lever arm of FIG. 11.
Figure 11:
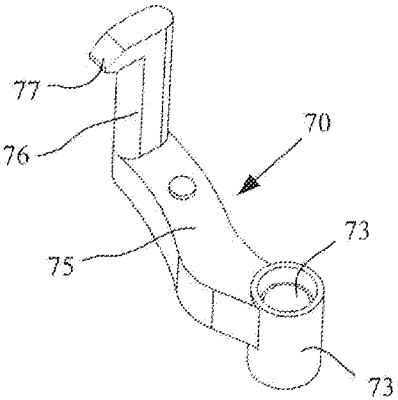
FIG. 11 is a bottom perspective view of the lever arm used for the sash lock assembly of FIG. 2.
Figure 14:
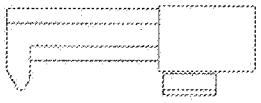
FIG. 14 is a first end view of the lever arm of FIG. 11.
Figure 18:
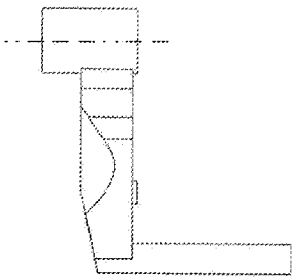
FIG. 18 is a rear view of the lever arm of FIG. 11.
Figure 16:
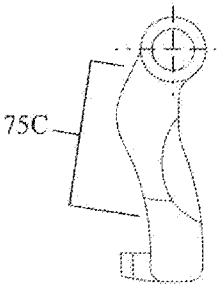
FIG. 16 is a first side view of the lever arm of FIG. 11.
Figure 13:
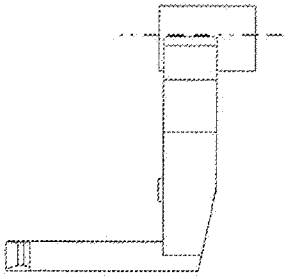
FIG. 13 is a front view of the lever arm of FIG. 11.
Figure 15:
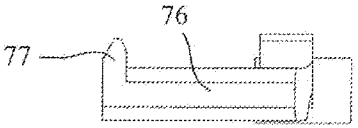
FIG. 15 is a second end view of the lever arm of FIG. 11.
Figure 17:
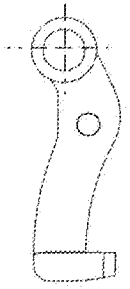
FIG. 17 is a second side view of the lever arm of FIG. 11.

The locking cam 50 is illustrated in FIGS. 8-10 and may have a cylindrical hub 53, with a keyed opening 54 that is shaped to match the keyed protrusion 44 of the shaft member 40. Extending laterally away from the hub 53 may be a wall 55, and extending laterally away from the wall 55 may be a curved cam wall 56, which may be used to engage the tooth of the corresponding keeper, and may also be used to draw the sliding sash window in closer proximity to the master window frame (or to the other sash window for a double-hung arrangement).

The curved cam wall 56 may have a protrusion 56P protruding laterally therefrom, which may be a cylindrically shaped protrusion or a part-cylinder. The axis of the cylindrically shaped protrusion 56P may be substantially parallel to the axis of the keyed opening 54.

Protruding away from the hub 53 may be a cylindrical member 57, which may be generally concentric with the hub, and through which the keyed opening 54 may also extend. The cylindrical member 57 may have a first flat 58A formed thereon, and a second flat 58B formed thereon to be clocked 180 degrees away from the first flat 58A. The flats 58A and 58B may co-act with a pair of identical leaf springs 90 and 90' (FIG. 5) to operate as a detent mechanism to releasably inhibit pivotal movement of the cam 50, when the cam is at an extended (lock) position, and when at another positioned termed herein as a second retracted (unlock) position.

The cylindrical member 57A may also have a third flat 59A formed thereon, as seen in FIG. 19, being located at a position that is clocked roughly 135 degrees from the first flat 58A. A fourth flat 59B may also be formed on the cylindrical member 57 at a position that is clocked roughly 180 degrees from the third flat 59A. The flats 59A and 59B may also co-act with respect to the leaf springs 90/90' at another sash unlocked position, which is termed herein as a first retracted unlock position. Although the detent mechanism could be formed using other component parts, and may also be formed using only one leaf spring 90, to provide greater stability of the cam in being releasably retained at those positions, the pair of leaf springs 90/90' may preferably be used. Note that the flats could be formed on the cylindrical hub 53, instead of on the protruding cylindrical member 57.

Interaction between the sash lock assembly 100 and the latch assembly 200, once installed with respect to the sliding sash window 400, may be through the use of the lever arm 70, which may be pivotally mounted within the housing 10.

The lever arm 70 is shown in detail within FIGS. 11-18. Lever arm 70 may include a hub 73, with a mounting hole 74 therein that may be generally concentric with the hub. Extending laterally away from the axis of the hub 73 may be an arm member 75, a portion 75C of which may be particularly contoured to act as a follower with respect to the cam 50. The arm member 75 may transition into a post 76 that may be generally orthogonal to the arm member 75, and may also be generally parallel to the axis of the hub 73.

As noted above, the component parts used for sash lock assembly 100 are shown in the exploded view of FIG. 19. As seen therein, initial assembly of sash lock assembly 100 may proceed with leaf springs 90/90' being installed into the housing cavity, to be positioned between the inwardly protruding walls (e.g., 33A, 33B) and the flat end surfaces (e.g., 17Ai, and 17Bi) of the curved walls 17A and 17B. The leaf springs may be secured thereat using a friction fit, or adhesive, or mechanical fasteners, etc., or any combination of such securement methods. Those wall features protruding into the housing cavity may be positioned such that the leaf springs 90 and 90', when secured therein, may be at a distance away from each other that is roughly the same as the distance used between the pair of flats 58A and 58B on the cam 50, which may be roughly the same as the distance between the pair of flats 59A and 59B.

The cylindrical shaft 43 of the shaft/handle member 40 may then be pivotally received in hole 20 of housing 10. The locking cam 50 may be joined to the shaft/handle member 40, with the keyed protrusion 44 of the shaft member 40 being received within the keyed opening 54 of locking cam 50, and being secured thereat using a friction fit, adhesive, mechanical fasteners, or by being welded thereto, or by using any combination of such suitable means of securing two parts together. Note that additional pivotal support for the cam 50 may be provided by the curved housing walls 17A and 17B pivotally receiving the hub 53 (or cylindrical portion 57) of the cam therebetween.

Next, the hole 74 of the hub 73 of the lever arm 70 may be pivotally received upon the shaft 25 of the housing. To pivotally secure the lever arm 70 thereto, the end of the shaft 25 may be bucked like a rivet, to form a manufactured head to prevent the lever arm from slipping off of the post. Alternatively, a screw or other mechanical fastener or component part may be used maintain the pivotal mounting of the hub 73 of the lever arm 70 upon the shaft 25 of the housing 10.

Figure 21:
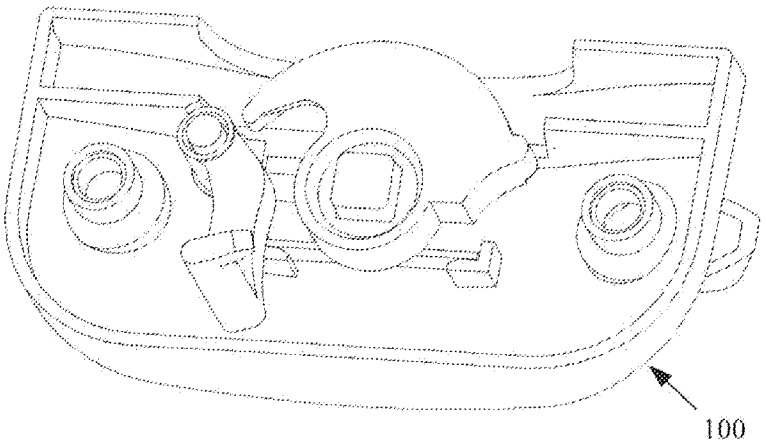
FIG. 21 is a bottom perspective view of the assembled sash lock assembly of FIG. 20, shown with the cam rotated into the extended locking position.
Figure 20:
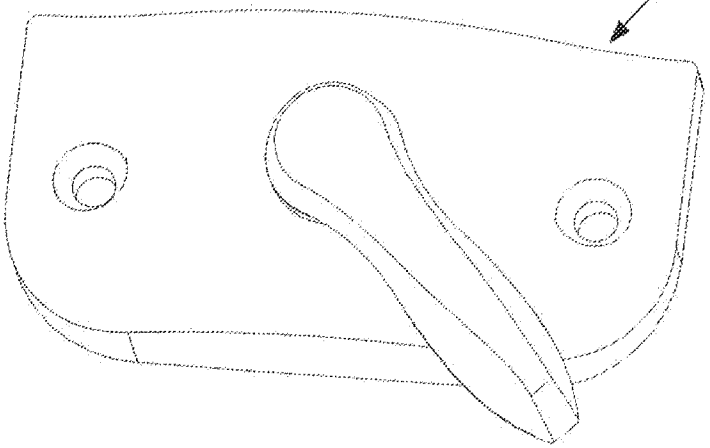
FIG. 20 is a top perspective view of the assembled sash lock assembly of FIG. 2.
Figure 22:
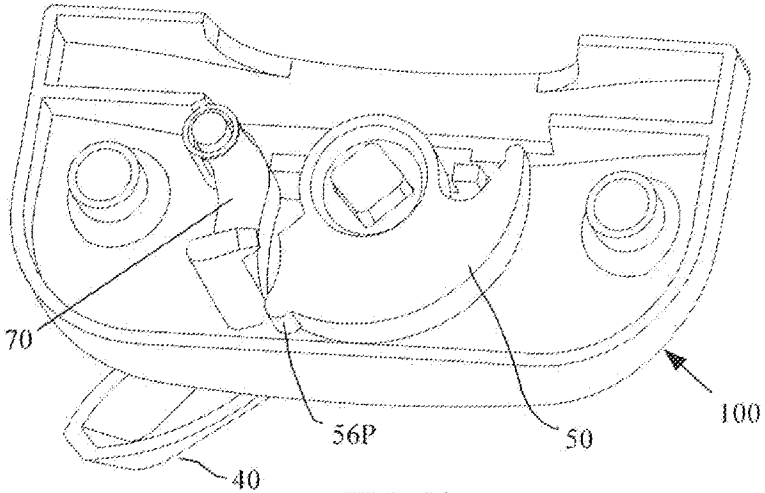
FIG. 22 is a bottom perspective view of the assembly sash lock of FIG. 21, shown with the cam rotated into the first retracted position.
Figure 25:
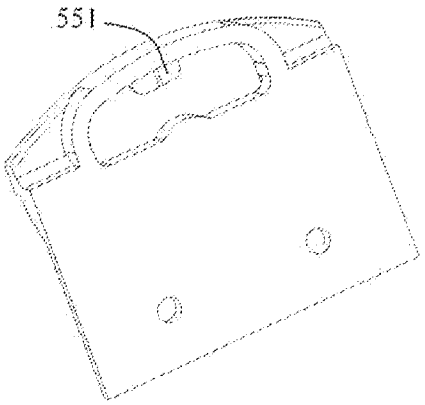
FIG. 25 is a rear perspective view of the keeper of FIG. 24.
Figure 24:
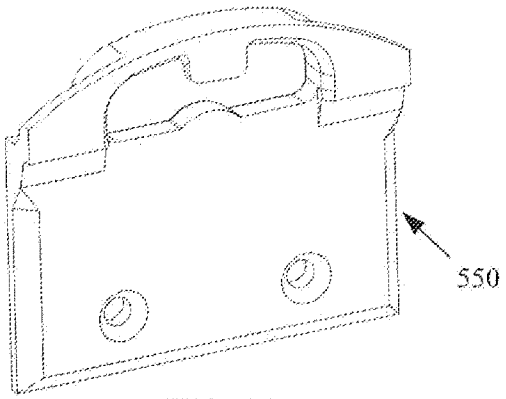
FIG. 24 is a front perspective view of a keeper that may be engaged by the cam of FIG. 23.
Figure 23:
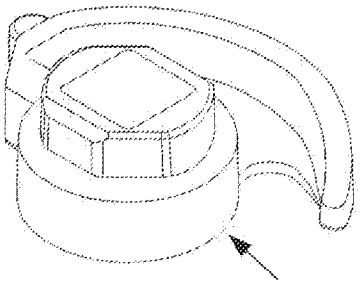
FIG. 23 is the top perspective view of the cam shown in FIG. 9.
Figure 28:
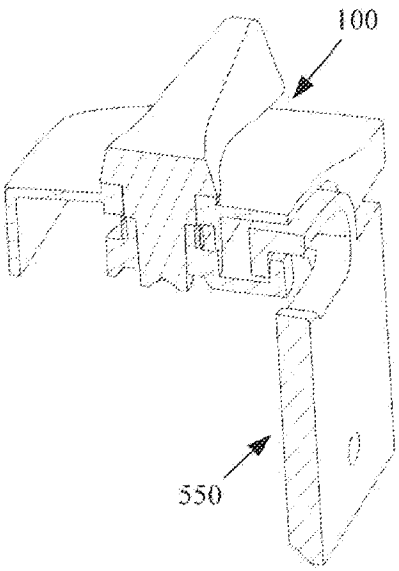
FIG. 28 illustrates a cutaway of the perspective view of FIG. 26, being cut on the other side of the cam axis.
Figure 27:
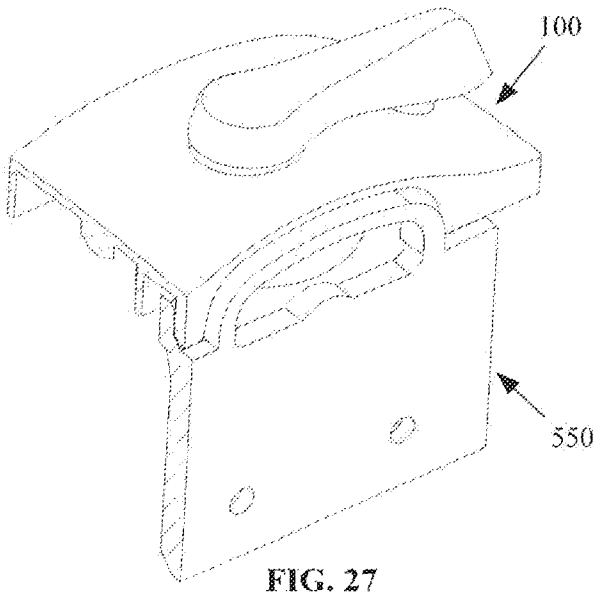
FIG. 27 illustrates a cutaway of the perspective view of FIG. 26, being cut on one side of the cam axis.
Figure 26:
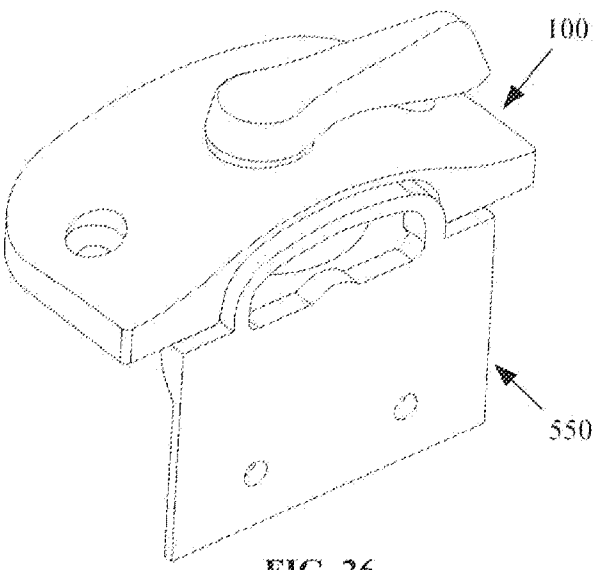
FIG. 26 is a perspective view illustrating the sash lock assembly of FIG. 22 positioned adjacent to the keeper of FIG. 24, and with the cam in the extended locking position to engage and be secured to a tooth of the keeper.

The assembled lock 100 is shown in FIGS. 20-22, the operation of which is discussed hereinafter, in conjunction with the latch assembly 200 and the corresponding installations with respect to the sash window 400.

Figure 30:
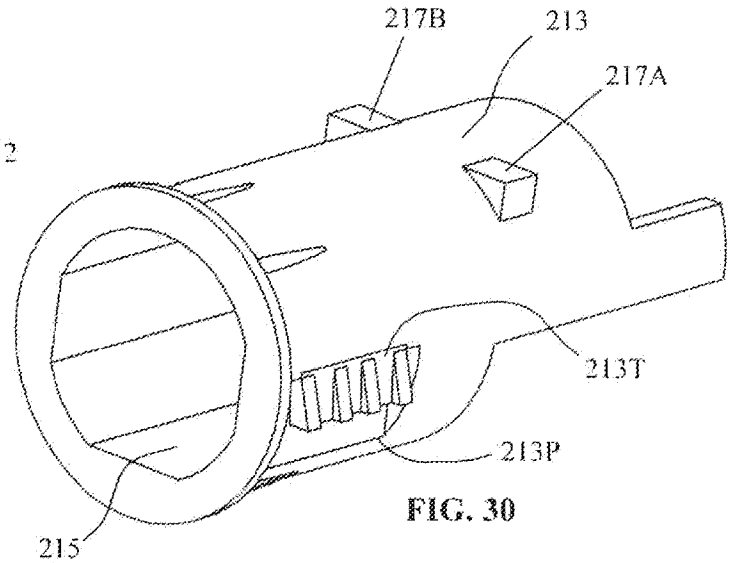
FIG. 30 is a second perspective view of the latch housing of FIG. 29.
Figure 29:
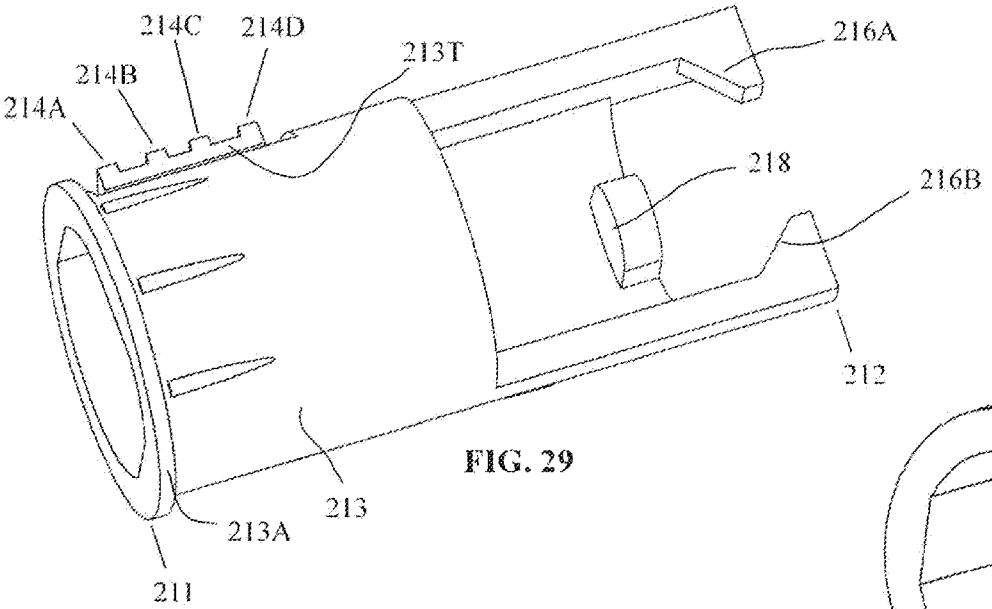
FIG. 29 is a first perspective view of the housing used for the latch assembly of FIG. 2.
Figure 31:
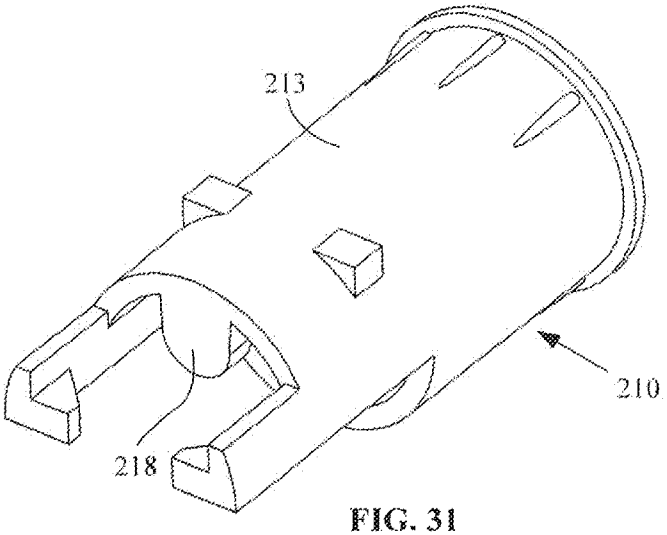
FIG. 31 is a third perspective view of the latch housing of FIG. 29.

The latch assembly 200 may include a latch housing 210, shown in FIGS. 29 to 31, which may have a simple exterior surface (e.g., generally cylindrical), the complement of which may be easily formed (e.g., bored) in the frame of the sliding sash window 400, to permit ease of its installation therein. The housing 210 is not limited to the shape illustrated within those figures, and could take on many different appropriate shapes, including an elongated rectangular shape. However, at least a portion of the housing 210 may be desirably shaped to have a cylindrical wall defined by a cylindrical outer surface 213, and an inner surface 215, each of which may have a portion that may span from a first end 211 to second end 212. At the first end 211 of the housing 210, an annular protrusion 213A may protrude outwardly from the cylindrical outer surface 213. An opening 213P may be formed in a portion of the cylindrical outer surface 213 to create a flexible tab portion 213T, upon which may be formed a series of spaced teeth (e.g., 214A, 214B, 214C, 214D,), which may be used for securing the housing within the opening formed in the frame of the sash window 400. To prevent the housing from rotating within the sash window, the housing may have a pair of triangular-shpaed tabs 217 protruding outward from the outer surface 213. Protruding inward from the interior surface 215 may be one stop or a pair of stops 216A and 216B. A wall 218 may also protrude inward to obstruct a portion of the hollowed out interior between the first end 211 and the second end 212. The housing 210 being so formed may slidably receive a latch member 250 therein.

Figures 32, 33, 34, 35, 36, 37, 38, 39:
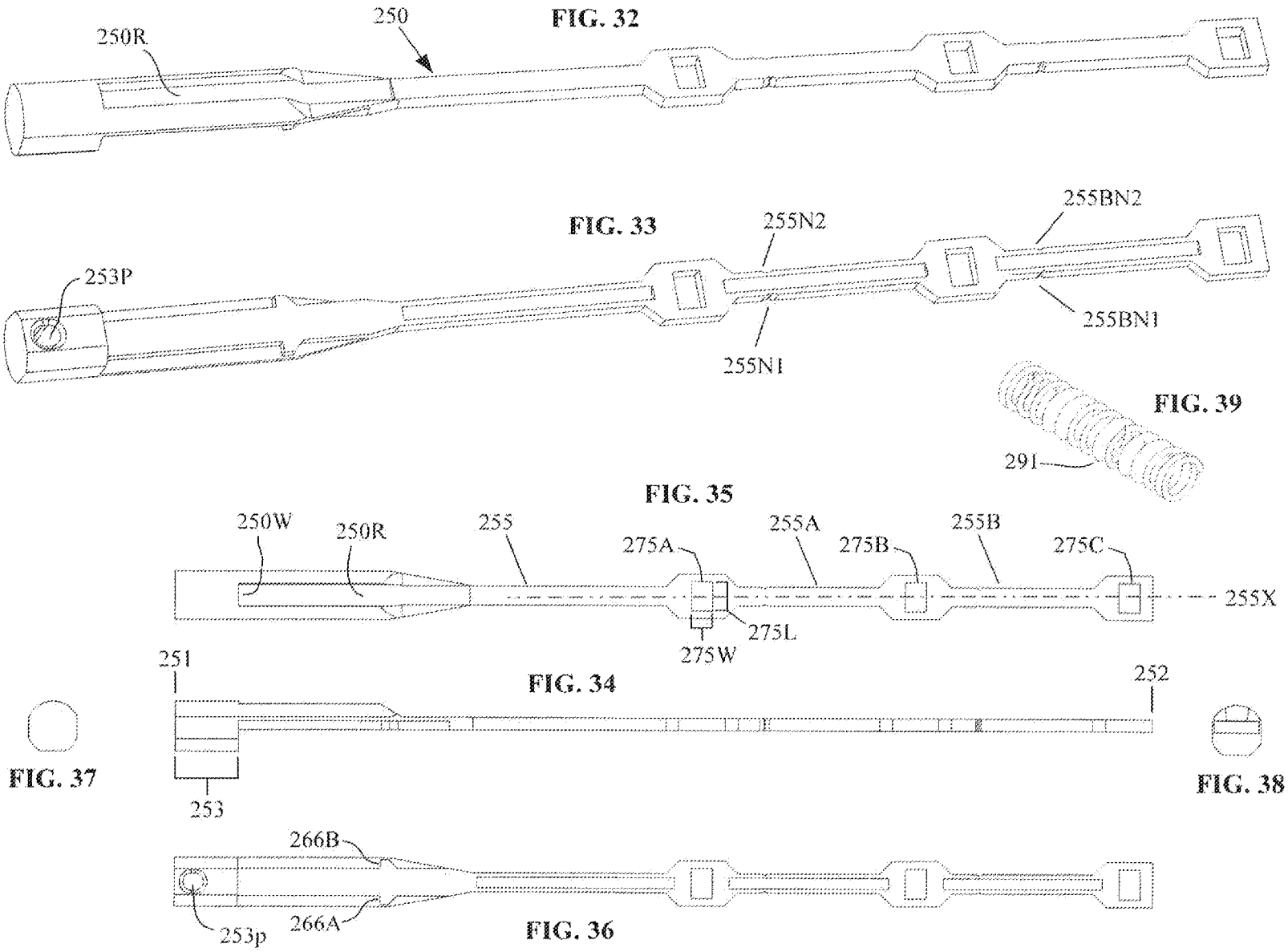
FIG. 32 is a first perspective view of the latch member used for the latch assembly of FIG. 2.
FIG. 33 is a second perspective view of the latch member of FIG. 32.
FIG. 34 is a front view of the latch member of FIG. 32.
FIG. 35 is a top view of the latch member of FIG. 32.
FIG. 36 is a bottom view of the latch member of FIG. 32.
FIG. 37 is a first end view of the latch member of FIG. 32.
FIG. 38 is a second end view of the latch member of FIG. 32.
FIG. 39 is a perspective view of a spring that may be used to bias the latch member of the latch assembly of FIG. 2.

Perspective views of the latch member 250 are shown in FIGS. 32-33, while corresponding orthogonal views are shown in FIGS. 35-38. The latch member 250 may extend from a first end 251 to a second end 252, and may include a tongue 253 that may begin at the first end of the latch member and may transition into a beam 255 that may extend to its second end. The tongue 253 may have an opening 253P formed therein, which may be a cylindrical opening. The latch member 250 may also have one stop protruding therefrom, or may instead have a pair of stops 266A and 266B protruding therefrom (FIG. 36).

The beam 255 may transition and widen to form peripheral walls about an opening 275A, the size of which may depend upon the cross-sectional shape of the post 76 of lever arm 70 of the lock assembly 100, to provide for engagement of the post 76 with the latch member, to couple motion therebetween. The opening 275A may be an elongated shape, which may, for example, be generally rectangular-shaped, as shown in FIGS. 35 and 36. The elongated opening may be oriented so that the longer direction of the opening is substantially perpendicular to the axis 255X of the beam 255. The rectangular opening 275A may therefore have a length 275L extending substantially normal to the axial direction 255X of the beam, and a width 275W extending substantially parallel to the axial direction of the beam.

Extending away from the far end of the peripheral walls formed about opening 275A may be a secondary beam 255A that may be formed substantially the same as beam 255, and the distal end of which may similarly widen to form peripheral walls about an opening 275B that may be constructed the same as opening 275A. Proximate to the connection of the beam 255A with the peripheral walls about opening 275A may be a first notch 255N1 on a first side of the beam and a second notch 255N1 on a second side of the beam, to produce an area that may be weakened with respect to a direction being normal to the axis 255X of the beam. The weakened area may be used to sever most of the secondary beam 255A from the peripheral walls associated with beam 255, where it may be necessary to use the first opening 275A for receiving the post 76 of the lever arm 70 of the sash lock 100, for installation of the latch assembly within a sash window frame of a particular size. A third beam 255B with peripheral walls about an opening 275C may be similarly formed. An additional pair of notches 255BN1 and 255BN2 may be formed to permit severing of most of the beam 255B.

Figure 40:
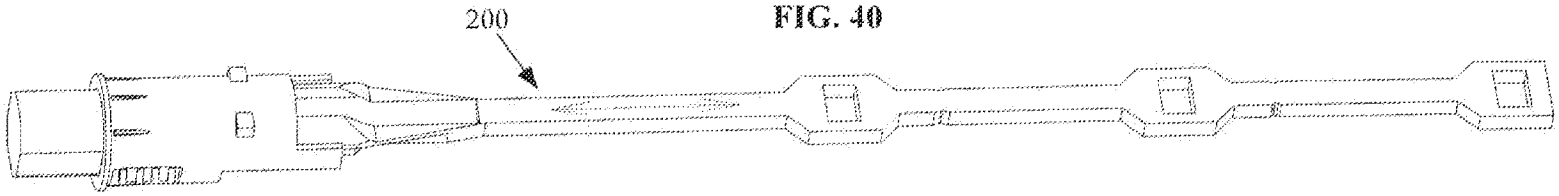
FIG. 40 is a first perspective view of the latch assembly used for the integrated sash lock/tilt latch fastener of FIG. 2.
Figure 41:
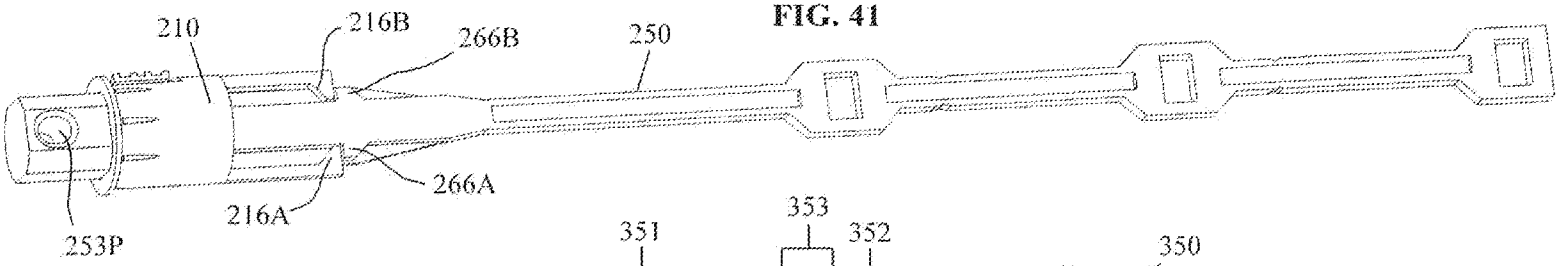
FIG. 41 is a second perspective view of the latch assembly of FIG. 40.

Biasing of the latch member 250 relative to the housing 210 may be through the use of a suitably arranged tension spring, or by using a compression spring. For the sake of brevity, the figures herein only depict an embodiment where a compression spring is utilized. The helical compression spring 291 (FIG. 39) may be received within a recess 250R formed in the latch member 250 (FIG. 35), and then the latch member and spring combination may be slidably received within the interior surface 215 of housing 210. One end of the spring 291 may act upon the wall 253W of the tongue 253, while the other end of the spring may act upon the wall 218 of the housing 210 (FIG. 29), to bias at least a portion of the tongue 253 to protrude out from the latch housing, as seen in FIGS. 40 and 41. The extent that biasing by spring 291 may cause the tongue 253 to protrude out from the housing 210 may be limited by the stops 266A and 266B on the tongue contacting the stops 216A and 216B on the housing (FIG. 41). Actuation of the latch member 250 relative to the latch housing 210 may cause at least a portion of the tongue 253 to retract within the hollow of the housing (see e.g., FIG. 51).

Figure 46:
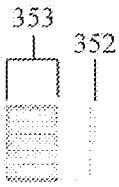
FIG. 46 is a side view of the post of FIG. 45.
Figure 47:
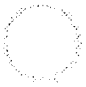
FIG. 47 is an end view of the post of FIG. 45.
Figure 42:
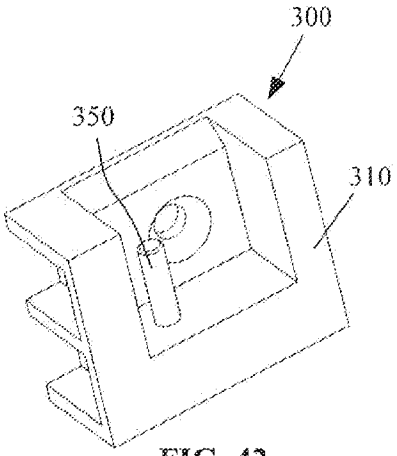
FIG. 42 is a front perspective view of the fitting assembly used with the integrated sash lock/tilt latch fastener of FIG. 2.
Figure 44:
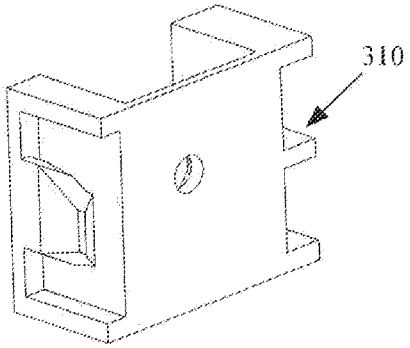
FIG. 44 is a rear perspective view of the housing of FIG. 43.
Figure 43:
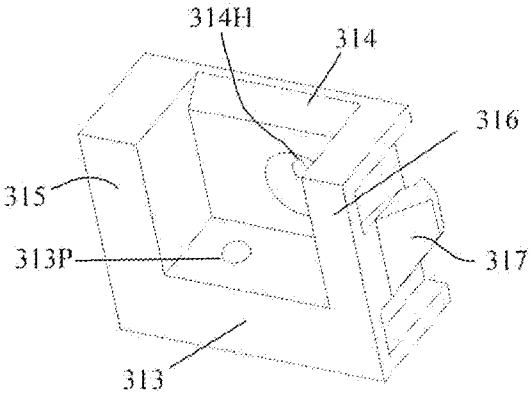
FIG. 43 is a front perspective view of a housing used for the fitting assembly of FIG. 42.

The latch assembly 200 may thus be configured to interact with the fitting assembly 300 that is shown in FIG. 2, and is also shown in the perspective view of FIG. 47. The fitting assembly 300 may be assembled using the housing 310 shown in FIGS. 43-44, and the post 350 shown in FIGS. 44-46.

The housing 310 of fitting assembly 300 may be formed to have a bottom wall 313, and a rear wall 314. The bottom wall 313 may have an opening 313P formed therein that may accommodate the cross-sectional shape used for the post member 350, so that the post may be mounted therein. The rear wall 314 may have a hole 314H, which may include a countersunk opening 314C to accommodate a flush-head mounting screw, which may be used for mounting of the fitting assembly 300 into the track of the master window frame 500. Since the track of the master window frame may be fairly narrow, and for other design reasons, a mounting fastener for the fitting assembly 300 may desirably be only used through the rear wall 314. Therefore, the housing 310 may be desirably formed as a bathtub fitting, with an extra thick bottom wall 313, and thick side walls 315 and 316. A flexible tab 317 protruding from the second side wall 316 may be used to optimally position the fitting assembly 300 within the track of the master window frame 50.

Figure 45:
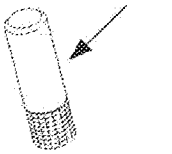
FIG. 45 is a perspective view of a post used for the fitting assembly of FIG. 42.

The post member 350 is shown in FIGS. 45-47 as having a circular cross-section, but other cross-sectional shapes may alternatively be used. For example, the post member 350 may also be desirably formed with a rectangular cross-section. The cylindrical post 350 may extend from a first end 351 to a second end 352, and may have a knurled surface 353 (FIG. 46) that may be formed proximate to the second end 352. The knurled surface 353 may be used for better securing of the post 350 within the orifice 313P of the housing 310, which securement may be enhanced using a friction fit, or adhesive, etc.

Figure 48:
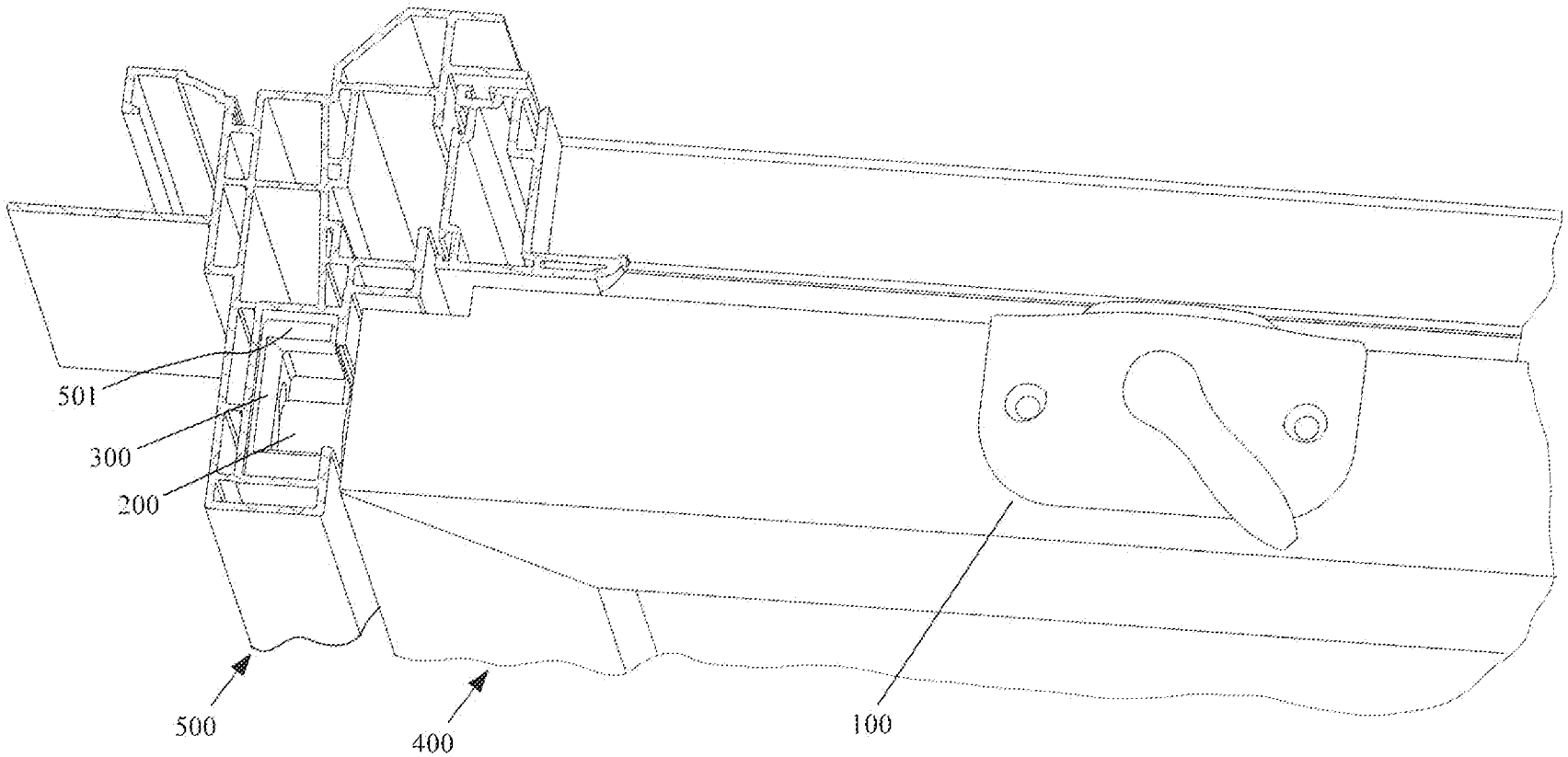
FIG. 48 is a cutaway view of the sliding sash window of FIG. 1, showing the fitting assembly of FIG. 42 installed into the track of the master window frame, and with the sash lock assembly and latch assembly of FIG. 2 installed upon and interconnected, within the sliding sash window.

The fitting assembly 300 may be installed into the track 501 of the master window frame 500, as seen in FIG. 48. The latch assembly 200 may be installed through an opening in the side of the sash window frame 400, which may be seen in FIG. 57, while the sash lock assembly 100 may be installed upon the top of the horizontal meeting rail 401.

The latch assembly may be size adjusted (i.e., removal of unnecessary beam section 255B or beam portions 255A and 255B), based upon proper positioning of the sash lock on the meeting rail, and the appropriate opening that may be formed therein. The suitable opening (e.g., 275A, 275B, or 275C) on the latch member 250 may be coordinated with and properly positioned for horizontal alignment below the sash lock assembly 100 when mounted upon the meeting rail 401 of the window frame 400 (see FIG. 57). For the window frame 300 shown in FIG. 116, the desired opening in the meeting rail 401 for the post 76 of the lever arm 70 of the sash lock assembly 100 may be positioned a particular distance away from the end of the window frame, which may accommodate alignment with opening 275B of the latch assembly 200 shown therein. In this case, the beam 255B could be removed using the notches 255BN1 and 255BN2, (although it is shown still attached within FIG. 57). For a larger window, the opening in the top of the meeting rail to accommodate mounting of the sash lock assembly 100 may be more appropriately positioned to be a greater distance away from the end of the window frame, and may thus be positioned for alignment with opening 275C of the latch assembly 200. Similarly, for a smaller window, the opening in the top of the meeting rail to accommodate mounting of the sash lock assembly 100 may be positioned a smaller distance away from the end of the window frame, and may be positioned for alignment with opening 275A of the latch assembly 200. In the latter example, the connection of the beam 255A may be severed using notches 255N1 and 255N2.

For the installation of the sash lock assembly 100 upon the meeting rail 401 of the sash window frame 400, after the post 76 of the lever arm 70 of the sash lock is passed through a suitable opening in the top of the meeting rail, the post must be received within the elongated opening 275B of the latch member 250 of the latch assembly 200. However, because of the elongated cross-sectional shape of the post 76 and the protrusion 77 protruding laterally therefrom (see FIG. 11), in order for the post to also be received into the elongated opening 275B of the latch member 250 of the latch assembly 200, the lock assembly should initially be positioned substantially transverse to the axial direction 401AX of the meeting rail 401A. Such initial positioning may orient the long transverse direction of the post 76 and the protrusion 77 of lever arm 70 to be perpendicular to the axial direction 301AX of the meeting rail 301A, so that it may be generally in-line with the lengthwise side 275L of the rectangular opening 275B in the latch member 250.

After insertion of the post 76 through the opening 275B of the latch member 250, the latch assembly 100 may then be rotated roughly 90 degrees, and then be lowered for the flat bottom surface of the sash lock housing 10 to contact and be flush with the top of the meeting rail, and be fastened thereto to using fasteners through the hollow cylindrical protrusions 15 and 16 of the housing 10. The 90 degree rotation of the sash lock assembly 100 after inserting the post 76 of the lever arm 70 through the opening 275B of the latch member 250 may thus orient the long transverse direction of the cross-section of the post to be parallel to the axial direction 301AX of the meeting rail 301A, so that it may be generally in-line with the shorter width direction 275W of the rectangular opening 275A in the latch member 250.

Figure 52:
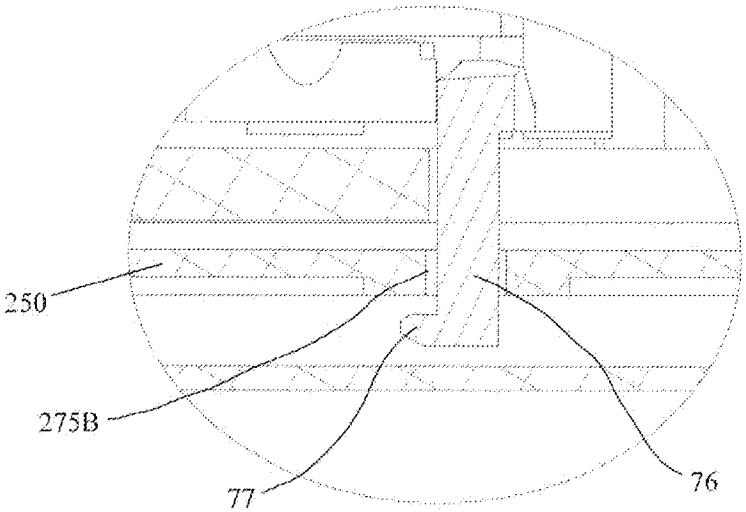
FIG. 52 is an enlarged detail view showing the interconnection between the lever arm of the sash lock assembly and the latch member of the latch assembly.

The width 275W of the rectangular opening 275A in the latch member 250 may be just slightly larger than the long transverse direction of the cross-section of the post 76 of lever arm 70 positioned therein (i.e., a slight clearance fit, as shown in the enlarged view of FIG. 52). With the interconnection being so configured, movement imparted to the lever arm 70 of the sash lock assembly 100 may cause corresponding movement of the latch member 250 of the latch assembly 200, and similarly, the biased movement of the latch member may cause a corresponding movement in the lever arm. The protrusion 77 may serve to prevent disconnection of the post 76 of the lever arm from the opening 275B in the latch member 250 (i.e., prevent the latch member from falling off of the post). For further information regarding this aspect of the installation, if required, a more detailed description and corresponding illustrations are provided within Applicant's co-pending application Ser. No. 14/278,226.

Figure 49:
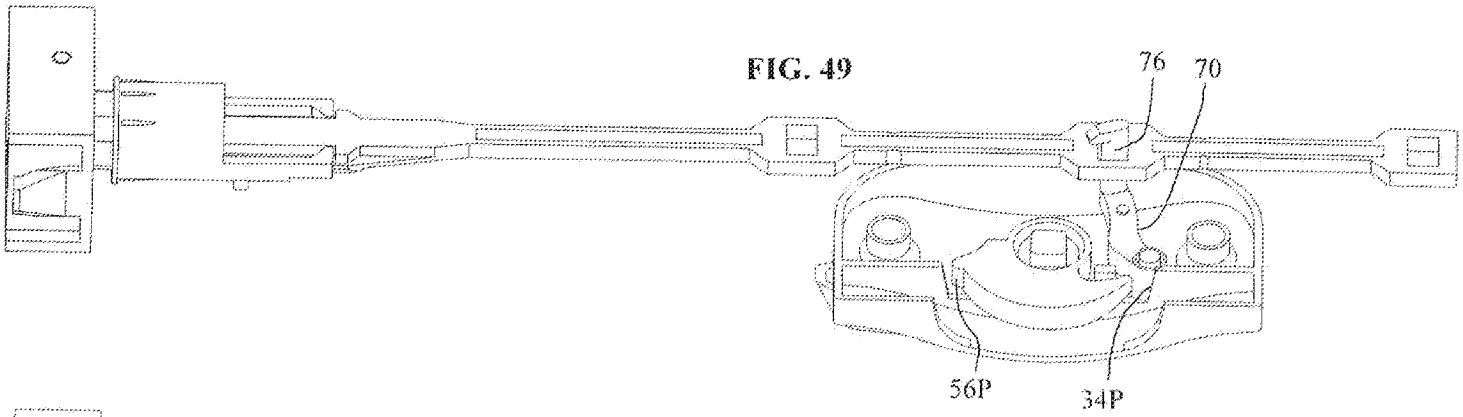
FIG. 49 is a perspective view illustrating the the sash lock assembly and latch assembly and the interconnection therebetween, when installed upon the sliding sash window, with the cam shown in the extended locking position, to engage the keeper (but not driving the lever arm), and also illustrating the latch member of the latch assembly engaged with the post of the fitting assembly.
Figure 50:
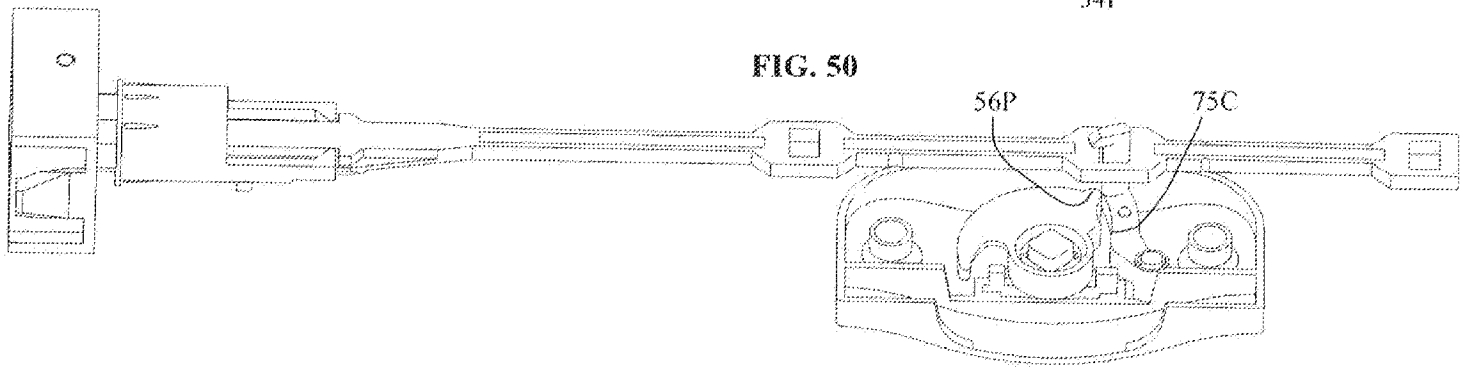
FIG. 50 is the perspective view of FIG. 49, but is shown with the cam in the first retracted position, to be moved proximate to the lever arm, but not yet driving the lever arm to correspondingly rotate.
Figure 51:
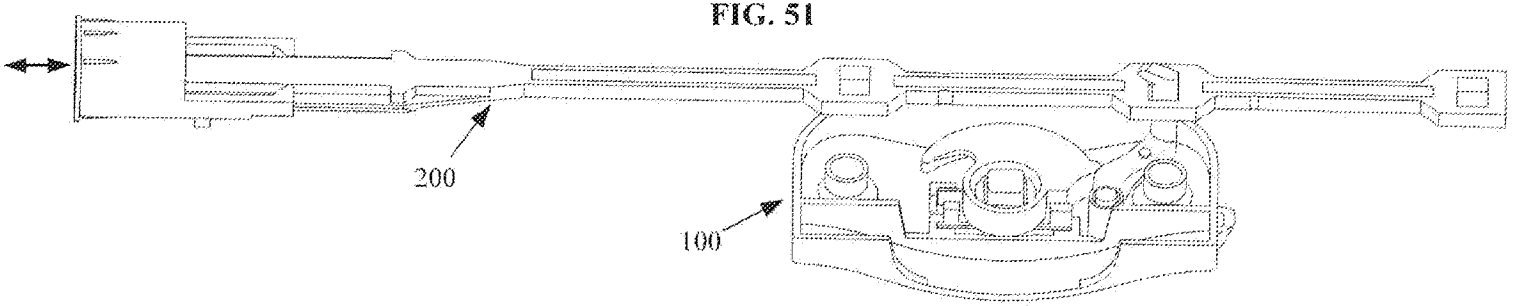
FIG. 51 is the perspective view of FIG. 50, but is shown with the interconnected sash lock assembly and latch assembly moved away from the fitting assembly, as would similarly be accomplished by opening the sliding sash window to disengage the latch member from the post of the fitting assembly, and with the cam having been rotated into the second retracted position, during which rotation the cam drives the lever arm, which actuates the latch member, causing it to also move into a retracted position.
Figure 53:
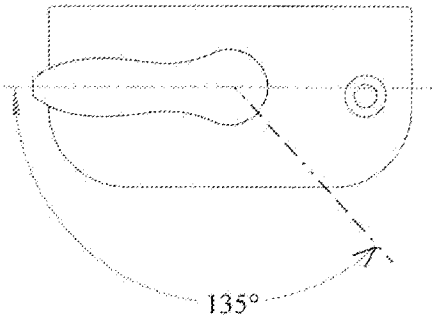
FIG. 53 is a top view of the sash lock assembly, with the handle shown positioned for the cam to be in the extended locking position.
Figure 54:
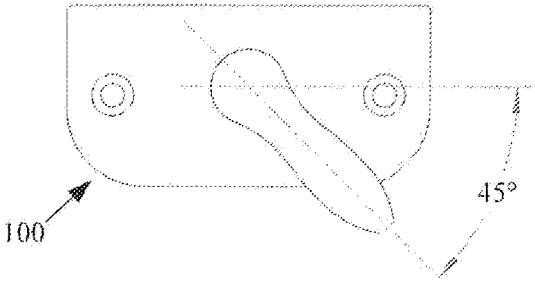
FIG. 54 is the top view of FIG. 53, but is shown with the handle rotated for the cam to be in the first retracted position, which rotation may be 135 degrees.
Figure 55:
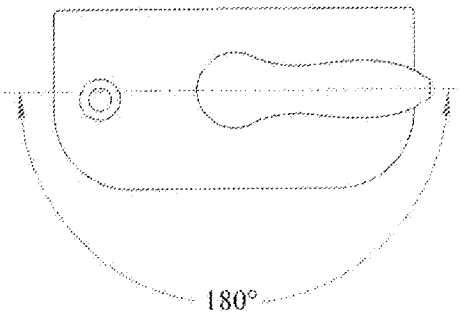
FIG. 55 is the top view of FIG. 54, but is shown with the handle rotated an additional amount for the cam to be in the second retracted position, which additional rotation may be 45 degrees.

With the sash lock assembly 100 and latch assembly 200 installed with respect to the sash window 400 as described, the shaft/handle member 40 of the lock assembly may be actuated to three different positions, as seen in FIGS. 53, 54, and 55, which may respectively correspond to the three different interrelated positions of the cam, lever arm, and latch member, as shown in FIGS. 49, 50, and 51. A tactile indication may be provided to the person moving the shaft/handle member 40, upon reaching each of those positions of the of the lock assembly 100, as a result of the detent mechanism provided by the flats on the cam 50 and the leaf springs 90/90'.

With the sash window 400 being in a closed position (FIG. 57), and with the shaft/handle member 40 positioned as shown in FIG. 53, the cam 50 may be in the extended locking position shown in FIG. 49 (i.e., a portion of wall 56 of the cam 50 protrudes out through the opening 12FP of the wall 12F of the housing 10 to engage the tooth 551 of the keeper 550). As seen in FIG. 49 (and FIG. 21), the cam 50 does not contact the follower portion 75C of the arm member 75, when in the extended locking position, and therefore, the post 76 is not actuated by the cam. As a result, the biasing of the latch member into its extended position by spring 291 also maintains the lever arm 70 in the position shown in FIG. 49, because of the interconnection therebetween.

With the sash window 400 being in that closed position and with the latch member 250 also biased into its extended position (FIG. 57), the post 350 of the fitting assembly 300 installed within the track of the master window frame 500 may be received within the opening 253P of the tongue 253 of the latch assembly 200. The size and positioning of post 350 may be such that it may be concentric with the opening 253P of the tongue 253, and with a very slight clearance fit therebetween. Therefore, with both a left-hand and right-hand sash fastener of the present invention installed on the sash window 400 (FIG. 1) to engage fitting assemblies 300 installed on both side tracks of the master window frame 500, both of the corners of the sliding sash window 400 may receive enhanced structural support in the closed and locked position. This structural support of the window may enhance its strength in the Z and X window directions shown in FIG. 1, beyond that which is provided by the typical tilt latch, and may prevent any significant deformation that would result in a breach in the seal between the exterior and the interior environment during extreme weather conditions (i.e., high wind loads).

Figure 58:
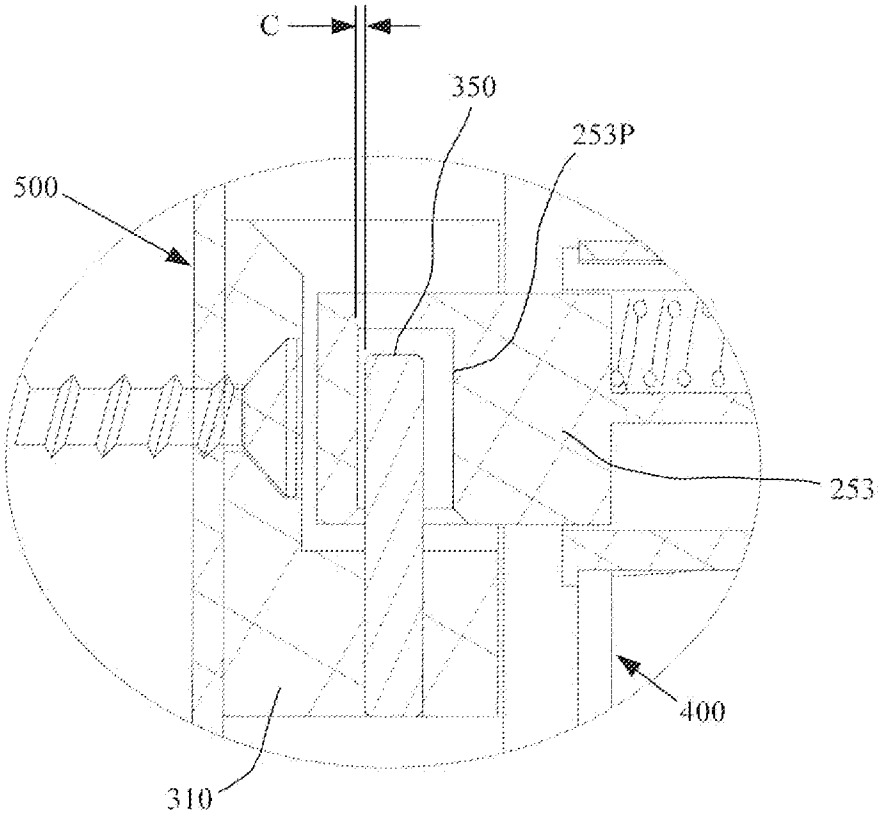
FIG. 58 is an enlarged detail view showing the post of the fitting assembly nested within the orifice of the latch member, as shown in FIG. 57, to secure the window against impact loading.

Alternatively, as shown in the enlarged view of FIG. 58, the cylindrical opening 253P of the tongue 253 may be larger than the diameter of the post 350, however, the relative positioning of parts may be such that there is only a slight clearance C between the side of the post most distal from the window center and the tongue 253, with a larger clearance on the proximal side of the post.

Figure 56:
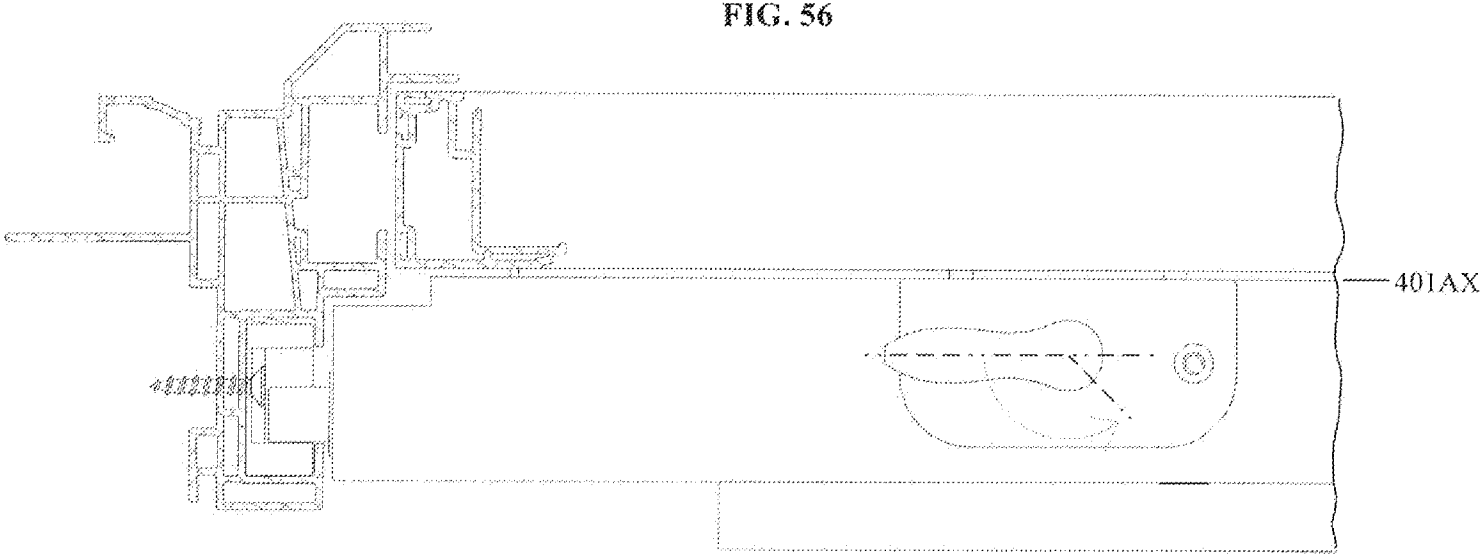
FIG. 56 is a top cross-sectional view through the window of FIG. 1, showing the sash lock handle positioned for the cam to be in the extended locking positon, with the latch member in the corresponding extended position, and with the sliding window in a closed position for the latch member to have the post of the fitting assembly nested in an orifice therein, to secure the window against impact loading.
Figure 57:
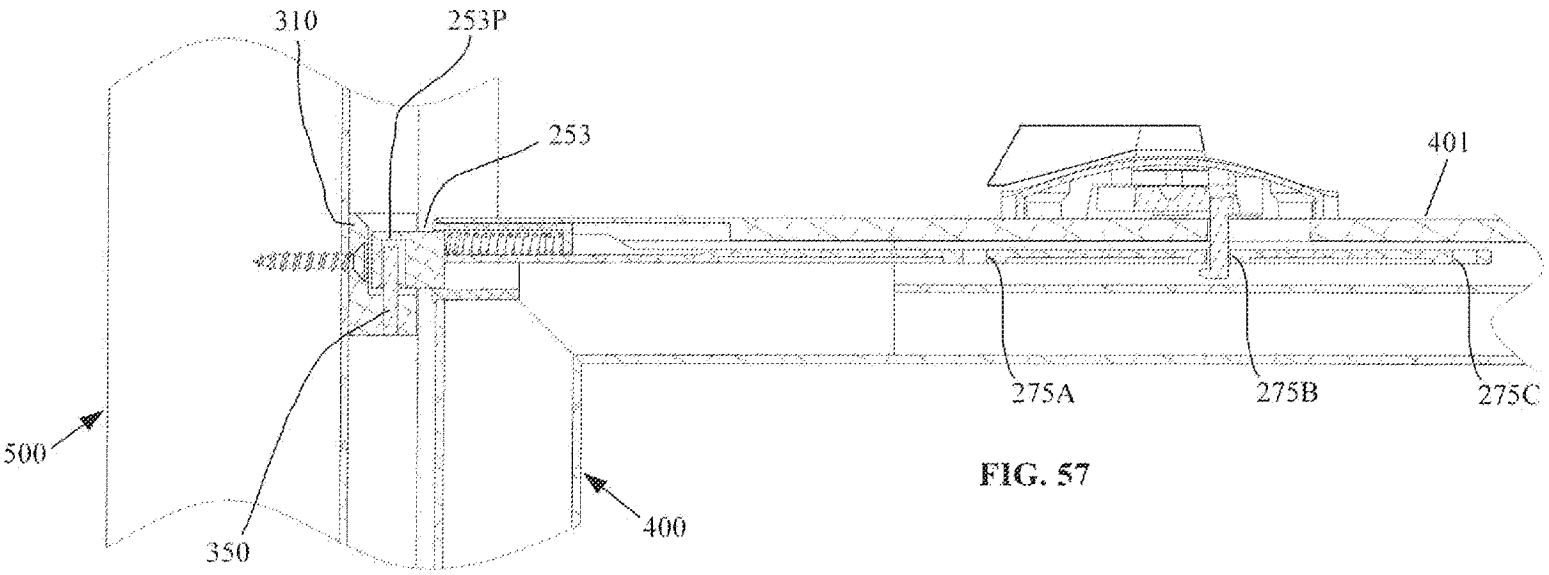
FIG. 57 is a front cross-sectional view of the window shown in FIG. 56.
Figure 59:
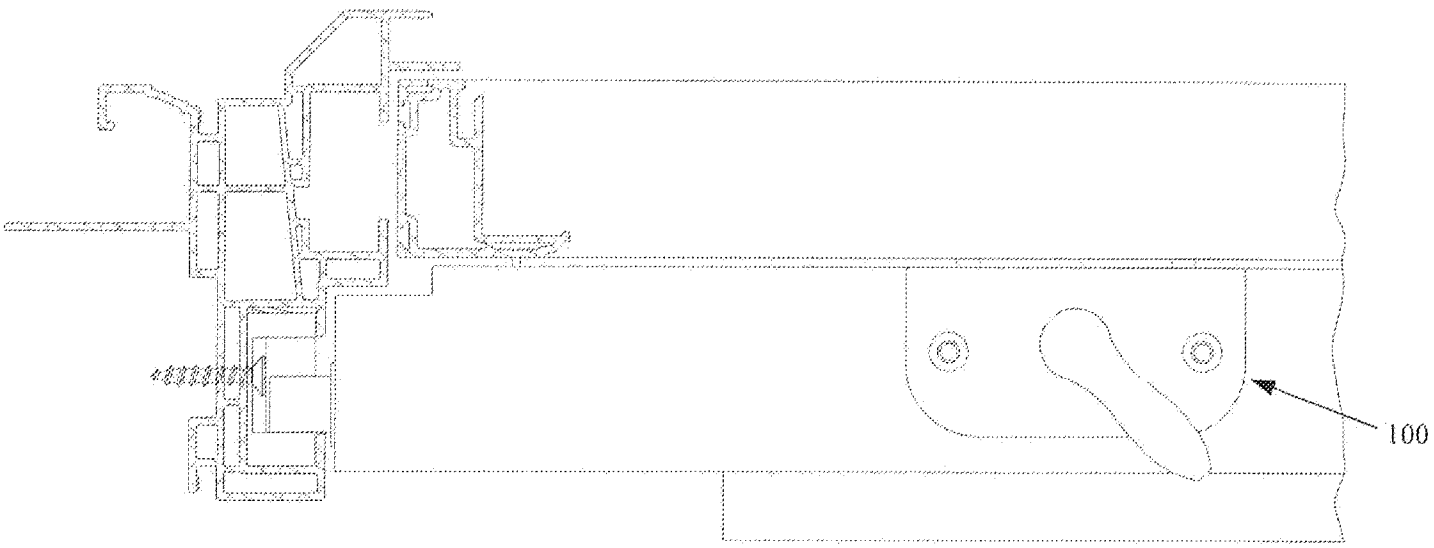
FIG. 59 is the top cross-sectional view of FIG. 56, but shown with the handle rotated to move the cam into the first retracted position to unlock the sliding sash window.
Figure 60:
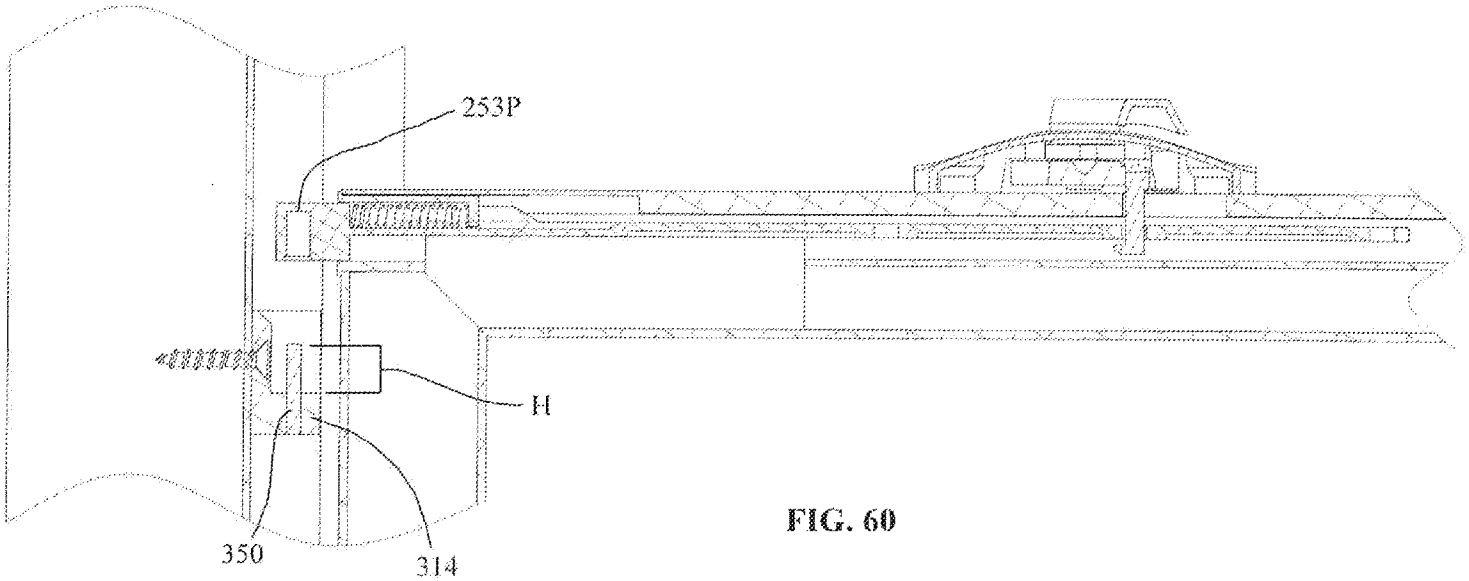
FIG. 60 is a front cross-sectional view of the window shown in FIG. 59.

The shaft/handle member 40 may be rotated 135 degrees for the cam 50 to move from the extended locking position shown in FIGS. 56-57, into the first retracted unlock position shown in FIGS. 59-60, to permit the sash window 400 to slide in the master window frame 500. As may be seen for the cam 50 and lever arm 70 positions within FIG. 50, the protrusion 56P of the cam 50 may only then just come into proximity to (or make minimal contact with) the follower portion 75C of the arm member 75, so that the lever arm 70 may substantially remain unaffected by the 135 degrees of cam rotation. With the window elevated sufficiently (i.e., greater than the protruding height H of the top of post 350 above the top surface of the wall 313 of the fitting housing 310), the post may no longer be nested within the opening 253P of the tongue 253 of the latch member 250.

Figure 61:
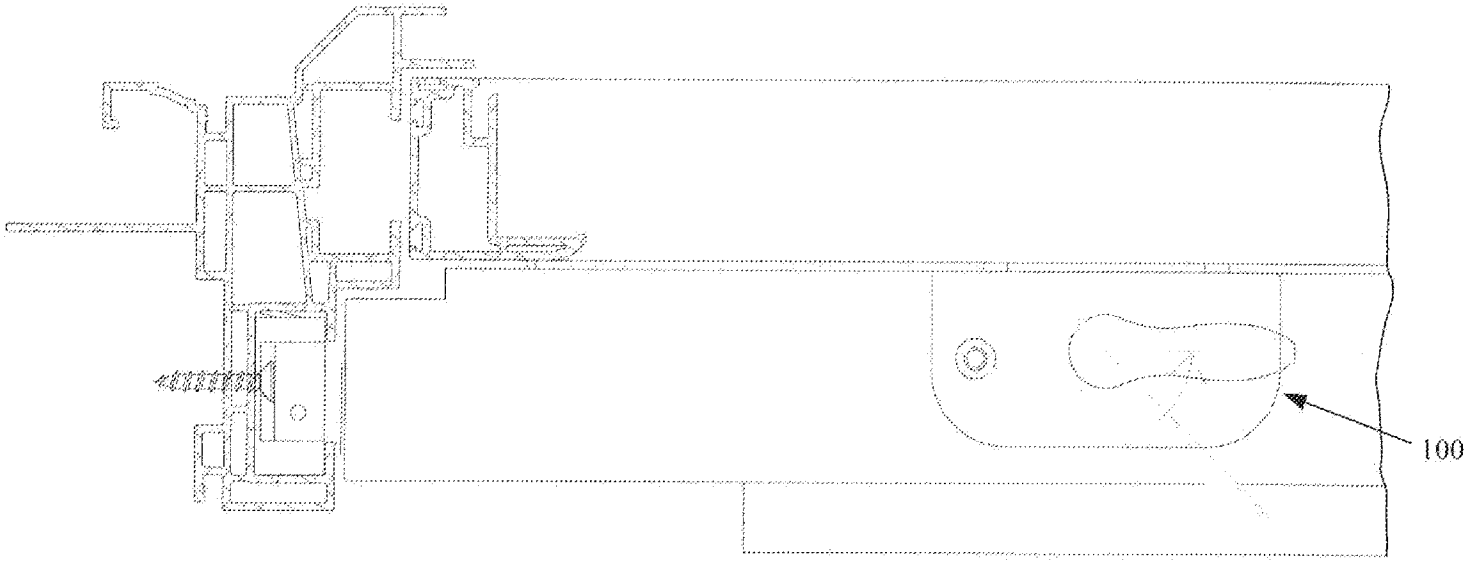
FIG. 61 is the top cross-sectional view of FIG. 59, but shown with the handle rotated further to move the cam into the second retracted position.
Figure 62:
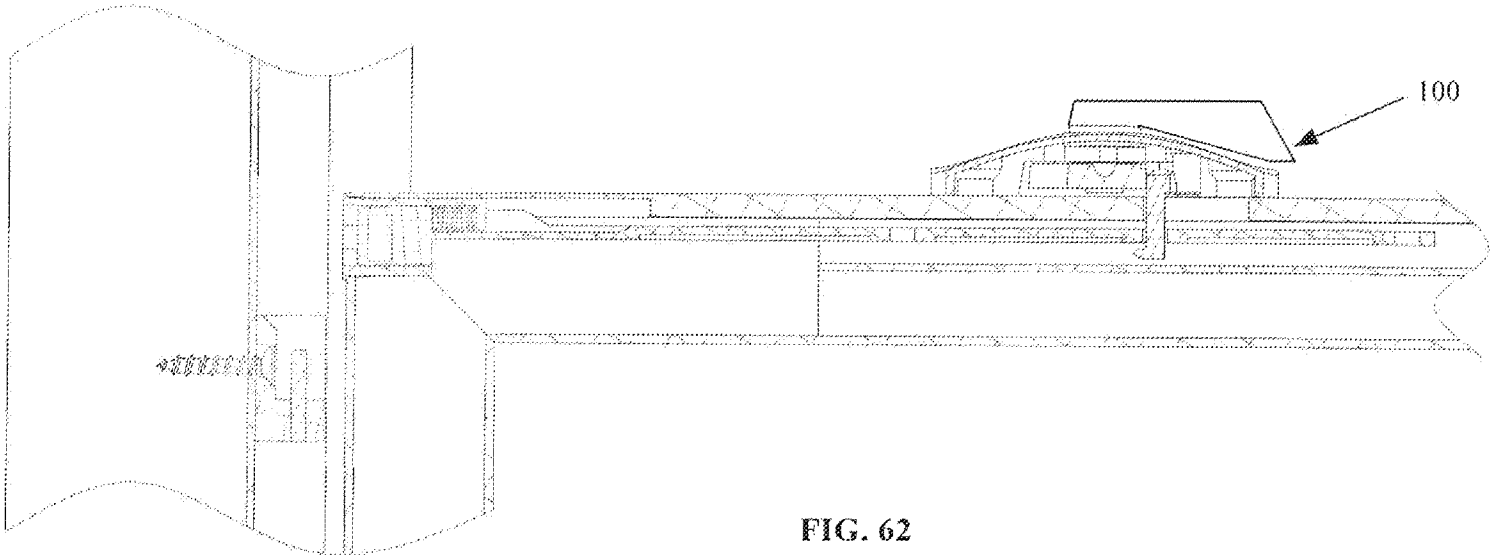
FIG. 62 is a front cross-sectional view of the window shown in FIG. 61.
Figure 64:
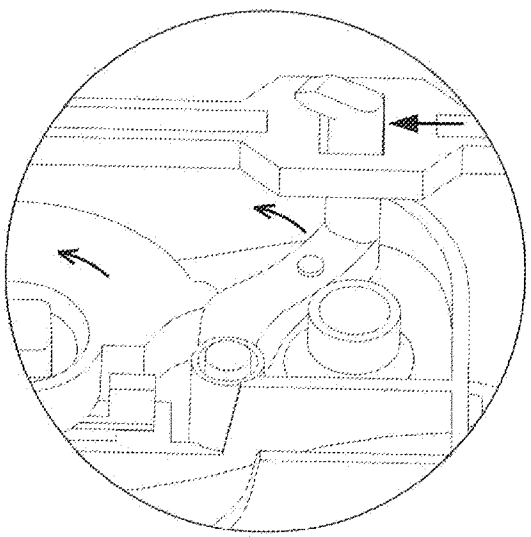
FIG. 64 is the enlarged detail view of FIG. 63, but shown with the cam having been rotated into the second retracted position, and having actuated the lever arm to drive the latch member into a retracted positon, to withdraw from the track in the master window frame.
Figure 63:
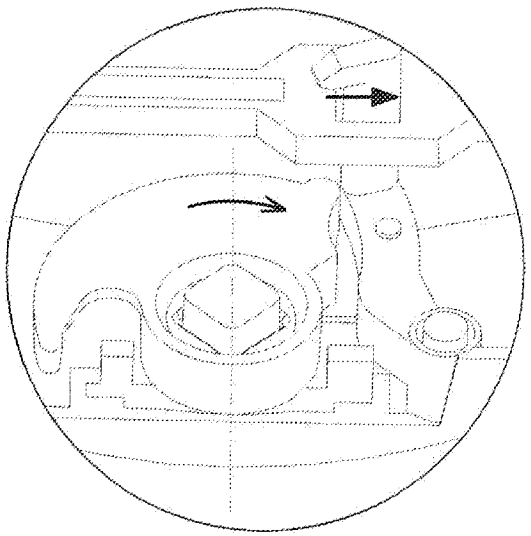
FIG. 63 is an enlarged detail view showing the interconnection between the lever arm of the sash lock assembly and the latch member of the latch assembly, with the cam in the first retracted position.
Figure 66:
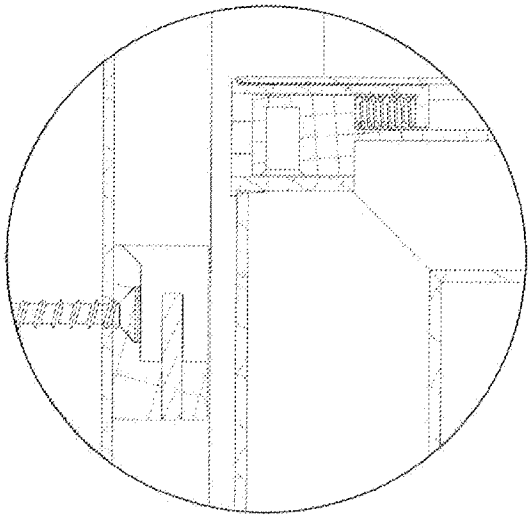
FIG. 66 is the enlarged detail view of FIG. 65, but showing the tongue of the latch member in the retracted position, which corresponds to the cam and lever arm positioning shown in the enlarged detail view of FIG. 64.
Figure 65:
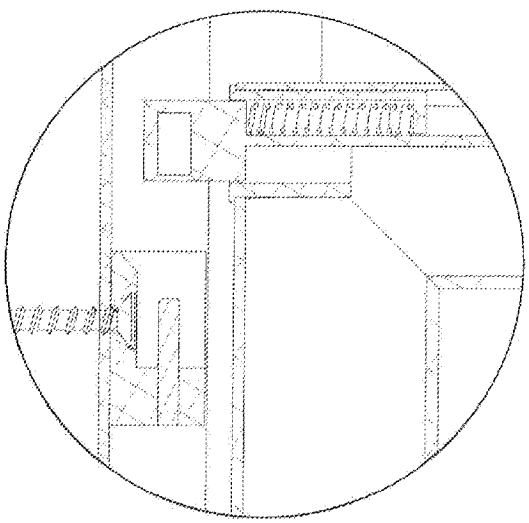
FIG. 65 is an enlarged detail view showing the tongue of the latch member in the extended position, but elevated away from the post of the fitting assembly in the track of the master window frame, which corresponds to the cam positioning shown in the enlarged detail view of FIG. 63.

If the user desires to tilt the sash window 400 into the room, the user may rotate the shaft/handle member 40 an additional 45 degrees for the cam 50 to move from the first retracted unlock position shown in FIGS. 59-60, into the second retracted unlock position shown in FIGS. 61-62. As may be seen for the cam 50 and lever arm 70 positions within FIG. 51, during the 45 degrees of rotation, the protrusion 56P of the cam 50 may contact and drive the follower portion 75C of the arm member 75, so that the lever arm 70 may co-rotate. During the co-rotation, the post 76 of the lever arm 70 may oppose the biasing provided by spring 291 and drive the latch member 250 to retract from track of the master window frame into the latch housing 210, as seen in FIG. 62. Once the user has tilted the sash window 400 out of the master window frame 500 and released the shaft/handle member 40, the bias of spring 291 acting upon latch member 250 may overcome the resisting force provided by the detent mechanism, and move the tongue 253 of the latch member back into the extended position, with the follower portion 75C of the lever arm 70 driving the cam to return to the first retracted unlock position.

When the user desires to tilt the sash window 400 back into the master window frame 500, the shaft/handle member 40 may again be rotated 45 degrees, so that the tongue may again be retracted into the latch housing 210. When the sash window 400 is positioned back in the master window frame 500, the shaft/handle 40 may be released, so that the tongue 253 may again be biased back into the track. The sash window 400 may then be closed, and the shaft/handle member 40 may be counter-rotated 135 degrees to lock the cam 50 with respect to the keeper 550 on the master window frame 500.

It should be noted that angular rotation amount other than 135 degrees is also possible, as long as the rotational movement from the extended locking position is sufficient to move the locking cam 50 far enough away from the keeper 550 to permit sliding movement of the sash window 400, and although it may be desirable, the cam need not even be fully retracted within the housing 10 when in the first retracted unlock position. Therefore, the herein described 135 degree and 45 degree rotational amounts are merely exemplary, and the fastener may be constructed so that other rotational amounts may alternatively be used to reach those key positions.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A combination locking and tilt latching fastener, for use on a sash window that is configured to be slidable and tillable with respect to a master window frame, said fastener comprising:

a fitting configured to be secured within a track of the master window frame; said fitting comprising a post configured to protrude upwardly a distance from a bottom surface of said fitting;

wherein said post comprises a circular cross-sectional shape;

a latch assembly comprising: a housing, a biasing means, and a latch member; said latch member having a first end and a second end, and comprising an opening, and a hole at said first end of said housing; said latch member slidably received within said latch housing to be slidable between a retracted position and an extended position where a portion of a first end of said latch member protrudes out from said housing first end; said biasing means configured to bias said latch member toward said extended position; said latch assembly configured to be received through an opening in a first side of a frame of the sash window for said latch housing to be secured thereto;

a lock assembly configured to be mounted to a meeting rail of the sash window frame, said lock assembly comprising: a housing, a cam, and an arm; said cam pivotally mounted within said lock housing and configured to engage a keeper on the master window frame when rotated into an extended position, for a portion thereof to protrude out of said lock housing, to lock the sash window in a closed position; said earn configured to rotate between said extended lock position and a first retracted position, and between said first retracted position and a second retracted position; said pivotally mounted within said lock housing and configured to have a portion thereof extend through an opening in the meeting rail, to be engaged within said opening in said latch member, for coupling of motion therebetween; said cam configured for a portion of said rotation therein to contact a follower portion of said arm to drive said arm to cause corresponding rotation of said arm, to cause said coupled motion of said latch member and lever arm;

wherein when the sash window is in the closed position, and when said cam is at said extended position to lock the sash window, said latch member is biased to engage the master window frame, and said post is received, in a slight clearance fit within said hole in said latch member, to further secure the sash window against impact loading;

wherein when the sash window is in the closed position, and when said cam is moved into said first retracted position to unlock the sash window to permit sliding, said latch member is biased to engage the master window frame to prevent tilt;

wherein when the sash window is moved at least said distance away from the closed window position into an open position, said latch member is moved away from said post and disengages from said fitting; and wherein when the sash window is in the open window position, and when said cam is moved into said second retracted position, said cam drives said lever arm, and said coupled motion between said lever arm and said latch member causes said latch member to, disengage from the master window frame to permit tilting of the sash window.

2. The combination locking and tilt latching fastener according to claim 1, further comprising a detent mechanism configured to releasably inhibit said pivotal travel of said cam when said cam is at said extended lock position.

3. The combination locking and tilt latching fastener according to claim 2, wherein said detent mechanism is further configured to releasably inhibit said pivotal travel of said cam when said cam is at said second retracted position.

4. The combination locking and tilt latching fastener according to claim 3, wherein said detent mechanism is further configured to releasably inhibit said pivotal travel of said cam when said cam is at said first retracted position.

5. The combination locking and tilt latching fastener according to claim 4, wherein said cam is rotated 135 degrees to reach said first retracted position from said extended lock position; and wherein said cam is rotated 45 degrees to reach said second retracted position from said first retracted position.

6. The combination locking and tilt latching fastener according to claim 5, said detent mechanism comprising:

a first leaf spring and a second leaf spring each fixedly mounted in said lock housing on opposite sides of said cam, and at a distance apart from each other;

said cam comprising: a cylindrical hub with a first pair of flats formed thereon to be parallel and at a distance apart being the same as said distance between said first and second leaf springs; and a second pair of fiats formed thereon to be parallel and also at a distance apart being, the same as said distance between said first and second leaf springs; said second pair of flats being clocked on said hub at 135 degrees from said first pair of fiats;

wherein said first and second leaf springs are configured to engage said first pair of flats on said cam for said detent mechanism to releasably inhibit said pivotal travel of said cam at said extended lock position and at said second retracted position; and wherein said first and second leaf springs are configured to engage said second pair of flats on said cam for said detent mechanism to releasably inhibit said pivotal travel of said cam at said first retracted position.

7. The combination locking and tilt latching fastener according to claim 6, wherein said arm is L-shaped, having a first leg and a second leg, with said first leg configured for said pivotal mounting to said lock housing, and said second leg configured as said follower portion; and wherein said cam comprises a rounded protrusion configured for said contact with said follower portion of said arm to cause said selective corresponding rotation of said arm.

8. The combination locking and tilt latching fastener according to claim 1, wherein said fitting comprises a bathtub fitting.

9. A window fastener, for use on a sash window configured to at least slide with respect to a master window frame, said window fastener comprising:

a sash lock assembly comprising a lock housing, a cam, and an arm, said arm being pivotable with respect to said lock housing; and said earn being pivotable with respect to said lock housing to occupy an extended locking position, and at least a first retracted unlock position;

a latch assembly comprising: a latch housing, a biasing means, and a latch member, said latch member comprising a hole; said latch member being selectively interconnected with said sash lock assembly and thereby configured to occupy two positions comprising urn extended latch position and a retracted latch position;

a fitting configured to be secured within a track of the master window frame; said fitting comprising a post configured to protrude upwardly a distance and configured to be selectively received within said hole in a slight clearance fit; wherein said post comprises a circular cross-sectional shape;

wherein when the sash window is in a closed window position and said cam is at said extended locking position: said cam is engaged with a keeper on the master window frame to lock the sash window; a portion of said latch assembly is engaged within a track of the master window frame; and said post is received within said hole for said latch member to engage said fitting to secure the sash window against impact loading;

wherein when said cam is moved into said first retracted unlock position, said cam is disengaged from the keeper to unlock the sash window to permit sliding away from the closed window position; and wherein when the sash window is moved at least said distance away from the closed window position into an open position, said latch member is moved away from said post and disengages from said fitting.

10. The window fastener according to claim 9, further comprising a detent mechanism configured to releasably inhibit said pivotal travel of said cam when said cam is at said extended locking position.

11. The window fastener according to claim 10, wherein said detent mechanism is further configured to releasably inhibit said pivotal travel of said cam when said earn is at said first retracted unlock position.

12. The window fastener according to claim 11, wherein said cam is rotated 135 degrees to reach said first retracted unlock position from said extended locking position.

13. The window fastener according to claim 12, wherein said detent mechanism comprises:

a first leaf spring and, a second leaf spring fixedly mounted in said sash lock assembly on opposite sides of said cam, and at a distance apart from each other;

said cam comprising: a cylindrical hub with a first pair of flats formed thereon to be parallel and at a distance apart being the same as said distance between said first and second leaf springs; and a second pair of flats formed thereon to be parallel and also at a distance apart being the same as said distance between said first and second leaf springs; said second pair of flats being docked on said hub at 135 degrees from, said first pair of flats;

wherein said first and second leaf springs are configured to engage said first pair of fiats on said cam hub for said detent mechanism to releasably inhibit said pivotal travel of said cam at said extended locking position; and wherein said first and second leaf springs are, configured to engage said second pair of flats on said cam hub to releasably inhibit said pivotal travel of said cam at said first retracted unlock position.

14. The combination locking and tilt latching fastener according to claim 9, wherein said fitting comprises a bathtub fitting.

15. A window fastener, for use on a sash window configured to at least slide with respect to a master window frame, said window fastener comprising:

a sash lock assembly comprising a lock housing, a cam, and an arm, said arm being pivotable with respect to said lock housing; and said cam being pivotable with respect to said lock housing to occupy an extended locking position, and at least a first retracted unlock position;

a latch assembly comprising: a latch housing, a biasing means, and a latch member, said latch member comprising a hole; said latch member being selectively interconnected with said sash lock assembly and thereby configured to occupy two positions comprising an extended latch position and a retracted latch position;

a fitting configured to be secured within a track of the master window frame: said fitting comprising a post configured to protrude upwardly a distance and configured to be selectively received within said hole in a slight clearance fit; wherein said post comprises a rectangular cross-sectional shape;

wherein when the sash window is in a closed window position and said cam is at said extended locking position: said cam is engaged with a keeper on the master window frame to lock the sash window; a portion of said latch assembly is engaged within a track of the master window frame; and said post is received within said hole for said latch member to engage said fitting to secure the sash window against impact loading;

wherein when said cam is moved into said first retracted unlock position, said cam is disengaged from the keeper to unlock the sash window to permit sliding away from the closed window position; and wherein when sash window is moved at least said distance way from the closed window position into an open position, said latch member is moved away from said post and disengages from said fitting.

* * * * *